US007681771B2

(12) United States Patent
Kandasamy et al.

(10) Patent No.: US 7,681,771 B2
(45) **Date of Patent: *Mar. 23, 2010**

(54) STAPLER

(75) Inventors: Balaji Kandasamy, Naperville, IL (US); Mark Harris, McHenry, IL (US); David Kirby, Lemont, IL (US); Edward T. Eaton, Wheaton, IL (US); David J. Papesh, Channahon, IL (US); Brian W. Matthews, Waterman, IL (US); Yoshiyuki Ebihara, Tokyo (JP); Yuki Hamaguchi, Tokyo (JP)

(73) Assignee: ACCO Brands USA LLC, Lincolnshire, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/424,629

(22) Filed: Jun. 16, 2006

(65) Prior Publication Data

US 2007/0057012 A1 Mar. 15, 2007

Related U.S. Application Data

(60) Provisional application No. 60/705,225, filed on Aug. 3, 2005.

(30) Foreign Application Priority Data

Jun. 17, 2005 (JP) ..... 2005-177441

(51) Int. Cl.
*B25C 5/11* (2006.01)

(52) U.S. Cl. ..... 227/134; 227/120; 227/132

(58) Field of Classification Search ..... 227/120, 227/132, 134, 124, 127
See application file for complete search history.

(56) References Cited

U.S. PATENT DOCUMENTS 200,774 A 2/1878 Somers (Continued)

FOREIGN PATENT DOCUMENTS

CN 2331510 8/1999

(Continued)

OTHER PUBLICATIONS

European Search Report and Search Opinion for corresponding European Application No. 06012294.2 mailed on Oct. 27, 2006.

(Continued)

*Primary Examiner*—Stephen Garbe
*Assistant Examiner*—Nathaniel Chukwurah
(74) *Attorney, Agent, or Firm*—Michael Best & Friedrich LLP

(57) ABSTRACT

A stapler movable between a rest position and a stapling position and having a front end and a rear end. The stapler includes a base, a staple magazine coupled to the base and configured to hold staples, and a driver blade operable to drive staples out of the staple magazine during stapling operations. The stapler further includes an elastic member coupled to the driver blade and operable to move the driver blade during stapling operations. The elastic member utilizes potential energy to move the driver blade during stapling operations. The driver blade is positioned above the staple magazine when the stapler is in the rest position and the magazine is extendable from the front end of the stapler to allow a user to load staples in the magazine. The stapler is configured such that only the potential energy of the elastic member can operate the driver blade during stapling operations.

20 Claims, 26 Drawing Sheets

U.S. PATENT DOCUMENTS

| | | | | |
|---|---|---|---|---|
| 1,493,072 | A | | 5/1924 | Fricker |
| 1,687,871 | A | | 10/1928 | Maynard |
| 1,852,060 | A | | 4/1932 | Peterson |
| 1,919,944 | A | | 7/1933 | Hicks |
| 1,962,874 | A | | 6/1934 | Polzer |
| 1,967,064 | A | | 7/1934 | Polzer et al. |
| 1,978,983 | A | | 10/1934 | Baur |
| 2,012,027 | A | | 8/1935 | Taylor et al. |
| 2,066,157 | A | | 12/1936 | Pankonin |
| 2,326,540 | A | | 8/1943 | Krantz |
| 2,340,717 | A | | 2/1944 | Vogel |
| 2,346,884 | A | | 4/1944 | Wheeler |
| 2,348,884 | A | | 5/1944 | Dewees |
| 2,420,830 | A | | 5/1947 | Maynard |
| 2,433,155 | A | | 12/1947 | Peterson |
| 2,469,984 | A | | 5/1949 | Pankonin |
| 2,481,892 | A | | 9/1949 | Wampler |
| 2,482,993 | A | | 9/1949 | Walker |
| 2,501,564 | A | | 3/1950 | Goodstein |
| 2,545,397 | A | | 3/1951 | Wampler |
| 2,645,773 | A | | 7/1953 | Dugin |
| 2,682,053 | A | | 6/1954 | Ruskin et al. |
| 2,710,964 | A | | 6/1955 | Spencer |
| 2,720,649 | A | | 10/1955 | Braun |
| 2,769,174 | A | | 11/1956 | Libert |
| 2,801,414 | A | | 8/1957 | Mueller |
| 2,923,938 | A | | 2/1960 | Rinehardt |
| 2,968,040 | A | | 1/1961 | Fenon |
| 3,034,128 | A | | 5/1962 | Robbins |
| 3,131,397 | A | | 5/1964 | Miller |
| 3,224,657 | A | | 12/1965 | Zike |
| 3,229,882 | A | | 1/1966 | Abrams |
| 3,265,278 | A | | 8/1966 | Robbins |
| 3,610,505 | A | | 10/1971 | Males et al. |
| 3,753,524 | A | | 8/1973 | Heyward |
| 3,862,712 | A | | 1/1975 | LaPointe et al. |
| 3,889,865 | A | | 6/1975 | Kuypers |
| 3,907,190 | A | * | 9/1975 | Mitsuhashi ..... 227/127 |
| 3,913,817 | A | | 10/1975 | Barrett et al. |
| 4,025,031 | A | | 5/1977 | Chi |
| 4,051,991 | A | | 10/1977 | Goodchild |
| 4,119,258 | A | | 10/1978 | Ewig, Jr. |
| 4,126,260 | A | | 11/1978 | Mickelsson |
| 4,150,774 | A | | 4/1979 | Wright |
| 4,184,620 | A | | 1/1980 | Ewig |
| 4,227,456 | A | | 10/1980 | Sato |
| 4,227,638 | A | | 10/1980 | Medina et al. |
| 4,273,281 | A | | 6/1981 | Smith et al. |
| 4,358,043 | A | | 11/1982 | Chi |
| 4,367,833 | A | | 1/1983 | Kenney |
| 4,399,938 | A | | 8/1983 | Biddle |
| 4,432,484 | A | | 2/1984 | Maestri |
| 4,450,998 | A | | 5/1984 | Ruskin |
| 4,452,388 | A | | 6/1984 | Fealey |
| 4,463,890 | A | | 8/1984 | Ruskin |
| 4,546,909 | A | | 10/1985 | Ebihara |
| 4,558,810 | A | | 12/1985 | Mulhauser et al. |
| 4,607,777 | A | | 8/1986 | Ebihara |
| 4,623,084 | A | | 11/1986 | Olesen |
| 4,629,108 | A | | 12/1986 | Judge |
| 4,687,098 | A | | 8/1987 | Ebihara |
| 4,706,865 | A | | 11/1987 | Ebihara |
| 4,706,866 | A | | 11/1987 | Ebihara |
| 4,717,062 | A | | 1/1988 | Ebihara |
| 4,717,063 | A | | 1/1988 | Ebihara |
| 4,724,992 | A | | 2/1988 | Ohmori |
| 4,763,824 | A | | 8/1988 | Ebihara |
| 4,778,096 | A | | 10/1988 | Ebihara |
| 4,784,307 | A | | 11/1988 | Ebihara |
| 4,796,793 | A | | 1/1989 | Smith et al. |
| 4,821,942 | A | | 4/1989 | Richards et al. |
| 4,869,415 | A | | 9/1989 | Fox |
| 4,981,245 | A | | 1/1991 | Sato |
| 5,038,991 | A | | 8/1991 | Thornton |
| 5,131,580 | A | | 7/1992 | Allman |
| 5,165,587 | A | | 11/1992 | Marks |
| 5,328,075 | A | | 7/1994 | Marks |
| 5,335,838 | A | | 8/1994 | Harris et al. |
| 5,335,839 | A | | 8/1994 | Fealey |
| 5,356,063 | A | | 10/1994 | Perez |
| 5,364,000 | A | | 11/1994 | Fealey |
| 5,407,118 | A | | 4/1995 | Marks |
| 5,413,266 | A | | 5/1995 | Jairam |
| 5,427,299 | A | | 6/1995 | Marks |
| D360,566 | S | | 7/1995 | Marks et al. |
| 5,497,932 | A | | 3/1996 | Brewer et al. |
| 5,505,362 | A | | 4/1996 | Marks |
| 5,511,716 | A | | 4/1996 | Marks |
| D384,257 | S | | 9/1997 | Marks et al. |
| D384,258 | S | | 9/1997 | Marks et al. |
| 5,664,722 | A | | 9/1997 | Marks |
| 5,671,879 | A | | 9/1997 | Lin |
| 5,699,949 | A | | 12/1997 | Marks |
| 5,702,046 | A | | 12/1997 | Rokita et al. |
| 5,758,813 | A | | 6/1998 | Kikuchi et al. |
| 5,765,742 | A | | 6/1998 | Marks |
| 5,816,470 | A | | 10/1998 | Plato et al. |
| 5,884,829 | A | | 3/1999 | Wingert |
| 5,938,101 | A | | 8/1999 | Izuchukwu et al. |
| 5,941,441 | A | | 8/1999 | Hagan |
| 5,967,397 | A | | 10/1999 | Fealey |
| 5,979,734 | A | | 11/1999 | Chang |
| 5,979,736 | A | | 11/1999 | Edeholt |
| 5,988,478 | A | | 11/1999 | Marks |
| 6,056,183 | A | | 5/2000 | Tanabe |
| 6,131,788 | A | | 10/2000 | Marks |
| 6,145,728 | A | | 11/2000 | Marks |
| 6,209,772 | B1 | | 4/2001 | Wang |
| 6,286,745 | B1 | | 9/2001 | Ackeret |
| 6,386,418 | B1 | | 5/2002 | Garner |
| 6,494,356 | B1 | | 12/2002 | Frank et al. |
| 6,561,406 | B1 | | 5/2003 | Furutsu et al. |
| 6,626,346 | B2 | | 9/2003 | Jairam et al. |
| 6,776,321 | B2 | | 8/2004 | Jairam et al. |
| 6,789,719 | B2 | | 9/2004 | Shor |
| 6,918,525 | B2 | | 7/2005 | Marks |
| 6,966,479 | B2 | | 11/2005 | Tanaka et al. |
| D513,159 | S | | 12/2005 | Marks et al. |
| D514,906 | S | | 2/2006 | Marks et al. |
| 7,097,086 | B2 | | 8/2006 | Joyce et al. |
| 7,121,444 | B2 | | 10/2006 | Joyce |
| 7,140,526 | B2 | * | 11/2006 | Matsukawa ..... 227/132 |
| 7,243,832 | B2 | | 7/2007 | Jiang |
| 7,299,960 | B1 | | 11/2007 | Marks |
| 7,540,400 | B2 | | 6/2009 | Zins et al. |
| 2003/0115738 | A1 | | 6/2003 | Barlow et al. |
| 2003/0178464 | A1 | | 9/2003 | Sinisi et al. |
| 2004/0084504 | A1 | | 5/2004 | Shor |
| 2004/0164120 | A1 | | 8/2004 | Boswinkel et al. |
| 2004/0232192 | A1 | | 11/2004 | Marks |
| 2004/0238592 | A1 | | 12/2004 | Shor |
| 2005/0098604 | A1 | | 5/2005 | Marks |
| 2005/0127129 | A1 | | 6/2005 | Marks |
| 2005/0139631 | A1 | | 6/2005 | Marks |
| 2005/0173488 | A1 | | 8/2005 | Ebihara |
| 2006/0016846 | A1 | | 1/2006 | Joyce |
| 2006/0102688 | A1 | | 5/2006 | Marks |
| 2006/0124685 | A1 | | 6/2006 | Joyce et al. |
| 2006/0186169 | A1 | | 8/2006 | Marks |
| 2006/0186170 | A1 | | 8/2006 | Marks |
| 2006/0191972 | A1 | | 8/2006 | Marks |
| 2006/0213948 | A1 | | 9/2006 | Marks |
| 2006/0213949 | A1 | | 9/2006 | Marks |
| 2006/0213950 | A1 | | 9/2006 | Marks |

| | | | |
|---|---|---|---|
| 2007/0034664 | A1 | 2/2007 | Jiang |
| 2007/0158382 | A1 | 7/2007 | Zins et al. |
| 2007/0158384 | A1 | 7/2007 | Zins et al. |
| 2007/0272721 | A1 | 11/2007 | Marks |

FOREIGN PATENT DOCUMENTS

| | | |
|---|---|---|
| FR | 2593251 | 7/1987 |
| WO | WO 2006/079785 | 8/2006 |
| WO | WO 2006/090878 A1 | 8/2006 |
| WO | WO 2007/107687 A1 | 9/2007 |

OTHER PUBLICATIONS

Novus B7 Stapler, Erwin Mueller German Catalog published Dec. 2005, p. 020-1056 (with English translation).
Mar. 4, 2008 Observations under Art. 115 EPC, filed in corresponding European Application EP 1 733 848.
May 13, 2008 Further Observations under Art. 115 EPC, filed in corresponding European Application EP 1 733 848.
Novus Collection Harmony Brochure, Stapler B 7 Automatic, 1 page, date unknown.
Sep. 10, 2008 Observations under Art. 115 EPC, filed in corresponding European Application EP 1 733 848.
PaperPro™ website, http://www.paperpro.com/technology, accessed Oct. 11, 2005, 2 pages.
Erwin Müller Gruppe Lingen website, http://www.erwin-mueller-gruppe.de/uk/marken/novus.htm, accessed Oct. 17, 2005, 2 pages.
PowerShot Tool Company, EasyShot Instruction Manual, Revised Sep. 2000, 5 pages.
PowerShot Tool Company, EasyShot Stapler website, http://128.241.143.29/tools/staple_guns/tool.php3?tid=2, accessed Oct. 13, 2005, 2 pages.
Arrow Fastener Company Staple Gun w/ Desk Attachment website, http://www.absolutehome.com/web/catalog/product_detail.aspx?pid=64321&cm_ven=M, accessed Oct. 13, 2005, 2 pages.
PaperPro™ website, http://www.paperpro.com/technology, accessed Oct. 11, 2005, 2 pages.
Erwin Müller Gruppe Lingen website, http://www.erwin-mueller-gruppe.de/uk/marken/novus.htm, accessed Oct. 17, 2005, 2 pages.
PowerShot Tool Company, EASYSHOT Instruction Manual, Revised Sep. 2000, 5 pages.
PowerShot Tool Company, EASYSHOT Stapler website, http://128.241.143.29/tools/staple_guns/tool.php3?tid=2, accessed Oct. 13, 2005, 2 pages.
Arrow Fastener Company Staple Gun w/ Desk Attachment website, http://www.absolutehome.com/web/catalog/product_detail.aspx?pid=64321&cm_ven=M, accessed Oct. 13, 2005, 2 pages.
Figures 1 - 2. Novus B7A Stapler, including statement of relevance, (admitted prior art).
Japanese priority Application No. 2005-144784, which is one of the priority applications listed for cited WO2006090878 (with English translation).

* cited by examiner

STAPLER

CROSS-REFERENCE TO RELATED APPLICATIONS

This application claims priority to U.S. Provisional Patent Application No. 60/705,225, filed Aug. 3, 2005, the entire content of which is incorporated by reference herein.

BACKGROUND

The invention relates to staplers, and more particularly, to staplers utilizing potential energy to assist in operating the staple drive mechanism. Potential energy or spring assisted office staplers have traditionally been of two types; either a stationary adaptation of powerful tacker-type models or a stationary stapler whose spring assist cannot achieve full power to drive and clinch the required sheet capacity without additional user applied force.

Typically, in a tacker-type stapler the staples are driven into the target object but the leg of staples are not bent. The strong force that is required for driving the staples is obtained by releasing the pressure that is accumulated in a spring or elastic member. Further, this structure that stores pressure in the spring can be of many different types but all are typically structured such that when the stapler is not in operation, the blade is located in front of the staples and when the blade is lifted, the staples move forward in the magazine. The blade is then lowered to drive one of the staples that has been pushed forward. This entire series of operations are executed in one instant with a powerful flow of force. Such a tacker is illustrated in U.S. Pat. No. 6,145,728. A stationary stapler adaptation of a similar mechanism is illustrated in U.S. Pat. No. 6,918,525.

In this type of tacker-type stapler configuration, when nothing is being stapled, there is a danger of staples flying out of the tacker inadvertently and it was necessary to develop a more complex structure in order to prevent such erroneous operations. Further, what is then seen in the tacker-type is a stationary configuration which requires loading the stapler from the rear due to the driver being in front of the staples and not lifted except during stapler operation. As a result, when the staples are reloaded, either the base or the magazine frame would have to be rotated and opened and the staples would then be fed. As such, more complex structures were adopted for each of inadvertent operation and staple reloading.

In the second type, spring assisted power has been applied within stationary staplers with a raised driver and without rear staple loading. However, previous approaches achieved very limited power gain given the limitations of known spring trigger mechanisms, known driver engagement mechanisms or other related linkages. These constructions only partly automate the function of the stapler and require additional manual force be applied to the driver when a stapler is operated at its sheet capacity, otherwise the staple would not be fully clinched under the paper. A stationary stapler adaptation of such an assist mechanism is illustrated in U.S. Pat. No. 5,356,063.

Both known types utilize locking mechanisms which act directly on the driver blade. These locking mechanisms intermittently experience functional problems including reduced power transmission to the driver, premature component failure, unreliable actuation and difficulty in returning to the rest position.

SUMMARY

This invention is a stapler that is used for binding together the target objects by driving the staples utilizing the force that has been accumulated in an elastic member, that force being released all at once. The invention is also related to a stapler where the driver blade is not positioned in front of the staples but rather above the staples when the stapler is not in use. Further, this invention fully automates the function of the stapler while achieving adequate power and maintaining the preferred loading method.

The invention could be utilized in a desktop-type stapler, where the staple legs are bent to bind together the target objects, or a tacker-type stapler where the staple legs are not bent. The desktop-type stapler of this invention reduces the possibility of the staples flying out by mistake and aims to obtain a stapling action that staples with a lot of power. Further, this is a stapler that is used for binding together papers and the like. The force that has been accumulated in the elastic object material is fed into the structure of the tacker from the viewpoint of releasing the force that has been stored up in the elastic member all at once and, as mentioned, it does not have a composition that is usually seen in tackers wherein the blade is located in front of the staples, but rather a structure where the blade is positioned above the staples.

Further the invention also aims to achieve a structure whereby there is no need for a large rotation or movement of the base or the frame when the staples are being reloaded. The invention also aims to have a function where not only will the staples not be ejected by mistake, but further the structure will be simple and the stapling operation can be performed with a light force.

In one embodiment, the invention provides a stapler movable between a rest position and a stapling position. The stapler has a front end adjacent a staple ejection location and a rear end. The stapler includes a base, a staple magazine coupled to the base and configured to hold staples, and a driver blade operable to drive staples out of the staple magazine during stapling operations. The stapler further includes an elastic member coupled to the driver blade and operable to move the driver blade during stapling operations. The elastic member utilizes potential energy to move the driver blade during stapling operations. The driver blade is positioned above the staple magazine when the stapler is in the rest position and the magazine is extendable from the front end of the stapler to allow a user to load staples in the magazine. The stapler is configured such that only the potential energy of the elastic member can operate the driver blade during stapling operations. In one embodiment, the elastic member is released by a triggering mechanism that does not directly contact the driver blade, thereby eliminating many of the triggering mechanism and locking mechanism problems of prior art staplers.

In another embodiment, the invention provides a stapler movable between a rest position and a stapling position. The stapler includes a staple magazine configured to hold staples, a driver operable to drive staples out of the staple magazine during stapling operations, and a drive mechanism coupled to the driver and operable to move the driver during stapling operations. The drive mechanism includes an elastic member for storing energy therein. The stapler further includes an activation member configured to engage the drive mechanism such that when a staple jam occurs, a user can manually reset the stapler to the rest position.

In some embodiments of the invention, an engagement part of the elastic member is engaged with a support member in the form of a slider, and as the cover and the frame come closer together due to the force input on the cover, the engagement part moves along the upper surface of the slider relatively until the engagement between the elastic member and the slider is released with the engagement part passing through the front end of the top surface of the slider. The slider is movable relative to the magazine in the forward and backward directions (i.e., longitudinally). In other configurations, the support member can take the form of a pivoting member attached in the frame and rotatable about a pivot axis.

In other embodiments of the invention, the slider includes a taper or arcuate surface in the front end of the slider, and the upper surface angle protrudes even farther out than a lower surface angle. With the cover and the frame coming closer together, the engagement part provides force such that the slider's upper surface front end is moved, leading to a disengagement of the elastic member and the slider. With a release of the force that is applied in a direction that brings the cover and the frame close together, the cover rises upwards and the engagement part of the elastic member rises along the taper or arcuate surface. Once the rising has been completed, the engagement part is engaged with the upper surface of the slider and with the help of the slider spring, the engagement portion of the engagement part and the slider are tilted in the direction that pushes the slider in the backward direction. With the engagement part pushing the upper surface of the slider back, the elastic member returns to the configuration that exists when the stapler is not in use.

In some embodiments of the invention, the stapler includes a means that helps in disengaging the elastic member and the slider. The slider is pushed back with respect to the frame due to engagement between the cover and the slider.

In yet other embodiments the elastic member is part of a drive mechanism coupled to the driver blade by a drive linkage that is in continuous contact with the driver blade during stapling operations. In one embodiment the drive linkage includes a driver link and an over-center link. The drive link has a first end connected to the driver blade, a second end coupled with the elastic member, and a pivot point intermediate the first and second ends. The over-center link is coupled with the driver link and is movable between a first position to prevent the drive link from pivoting about the pivot point, and a second position to allow the drive link to pivot about the pivot point to drive the driver blade Typical potential energy stapler technology utilizes a portion of the frame to prevent the driver blade from extending out of the bottom of the magazine. Preventing the driver blade from extending out of the magazine reduces the stapling power and can generate a considerable amount of noise. The stapling force is reduced because the driver blade is suddenly stopped during stapling. Therefore, more force needs to be generated by the stapler than the actual force that is required for stapling because energy is consumed to prevent the driver blade from extending out of the magazine.

The driver blade of the stapler of the present invention is allowed to extend out of the magazine during stapling. Thus, there is generally no need to stop the blade from extending past the bottom of the magazine. As a result, less force needs to be generated by the stapler of the present invention versus typical potential energy staplers because energy is not consumed to stop the driver blade. Therefore, comparing the stapler of the present invention with typical potential energy staplers, the current stapler can staple the same amount of sheets or other items with less force. In addition, the stapler of the present invention generates less noise than typical potentially energy staplers because the driver blade is not suddenly stopped.

Since the blade starts from above the staples, a front-loading mechanism or arrangement can still be used. Further the stapler of the present invention provides a stapler with potential energy technology while only slightly increasing the number of component parts from non-potential energy type staplers.

The elastic member coupled to the underside of the cover creates a compact design such that the space required for the working components is less than staplers with other types of potential energy technology. When this feature is added to the fact that the number of parts is less, the freedom in the design is greatly enhanced and it is easy to construct this device such that it is more compact than staplers with other types of potential energy technology.

Further, it is possible to change the force provided by the plate spring by making changes to the plate thickness and configuration, and has therefore becomes easier to apply this new technology over a wide range of devices starting from small staplers that require only minimal amount of force for stapling and extending to large staplers that need more force for the stapling action.

A stapler with other potential energy technology needs to have various safety measures and features to facilitate reloading the staples. The driver blade in the present invention is initially at rest above the staples and there is no spring force in the blade. Therefore, it is easy to obtain the same level of safety as a conventional stapler when reloading the staples.

Other features and advantages of the invention will become apparent to those skilled in the art upon review of the following detailed description, claims, and drawings.

BRIEF DESCRIPTION OF THE DRAWINGS

FIGS. 5*a*'-5*e*' relate to FIGS. 5*a*-5*e* respectively and illustrate a portion of the stapler of FIG. 1 during the operation of the stapler.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The present invention will be described with reference to the accompanying drawing figures wherein like numbers represent like elements throughout. Certain terminology, for example, "top", "bottom", "upper", "lower", "front", "rear", "up", "down", "right", "left", "clockwise", "counterclockwise" is used in the following description for relative descriptive clarity only and is not intended to be limiting.

DETAILED DESCRIPTION

Figure 1:
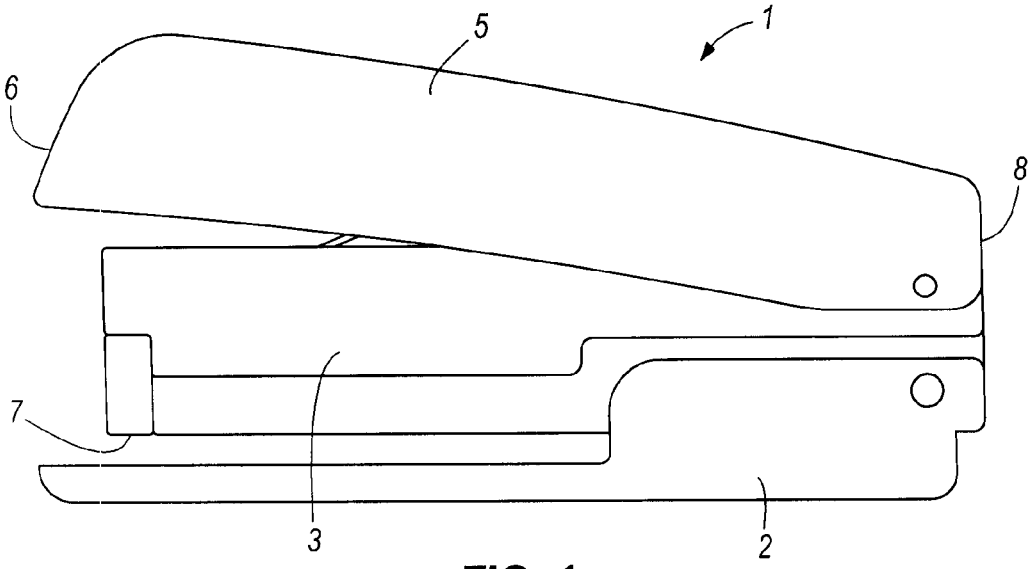
FIG. 1 is an external view of the stapler embodying the present invention.
Figure 2:
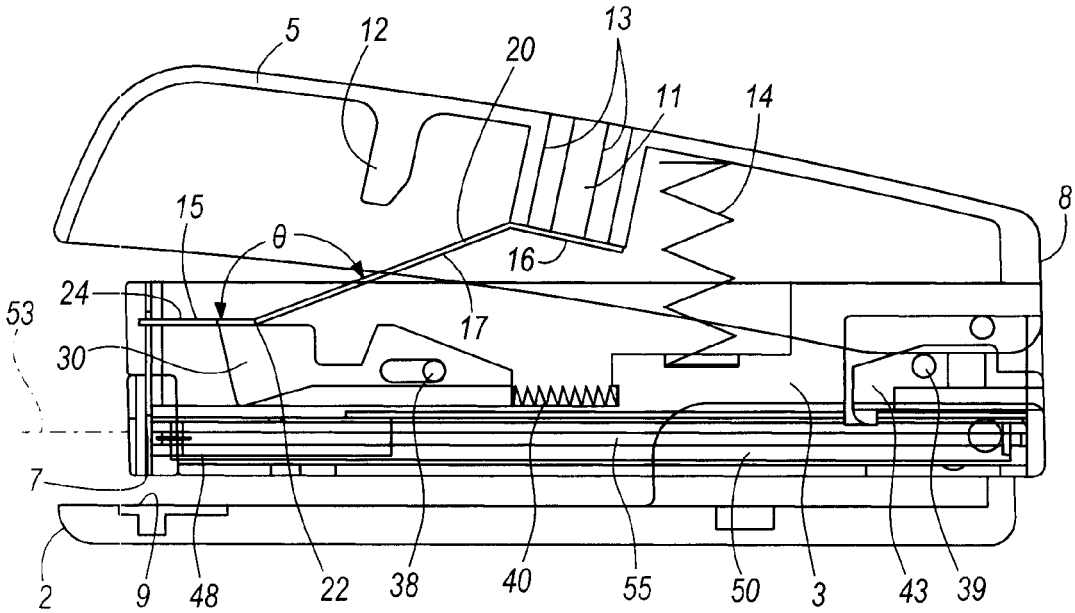
FIG. 2 is a cutaway view of the stapler of FIG. 1, illustrating the internal configuration of the stapler when the stapler is not in use.

A first embodiment of a stapler 1 is illustrated in FIGS. 1-11. The external appearance of the stapler 1 is as seen in FIG. 1. Referring to FIGS. 1 and 2, the stapler 1 defines a front end 6, adjacent a staple ejection location 7, and a rear end 8 opposite the front end 6. The stapler 1 includes a base 2, a frame 3 that is coupled to the base 2, and a handle or cover 5 that is coupled to the frame 3 near the rear end 8 of the stapler 1.

The illustrated base 2 includes an anvil 9. As is understood by one of skill in the art, the anvil 9 facilities clinching or bending staples. The base 2 supports the stapler 1 on a support surface, such as a desk, table, countertop, and the like.

Figure 3:
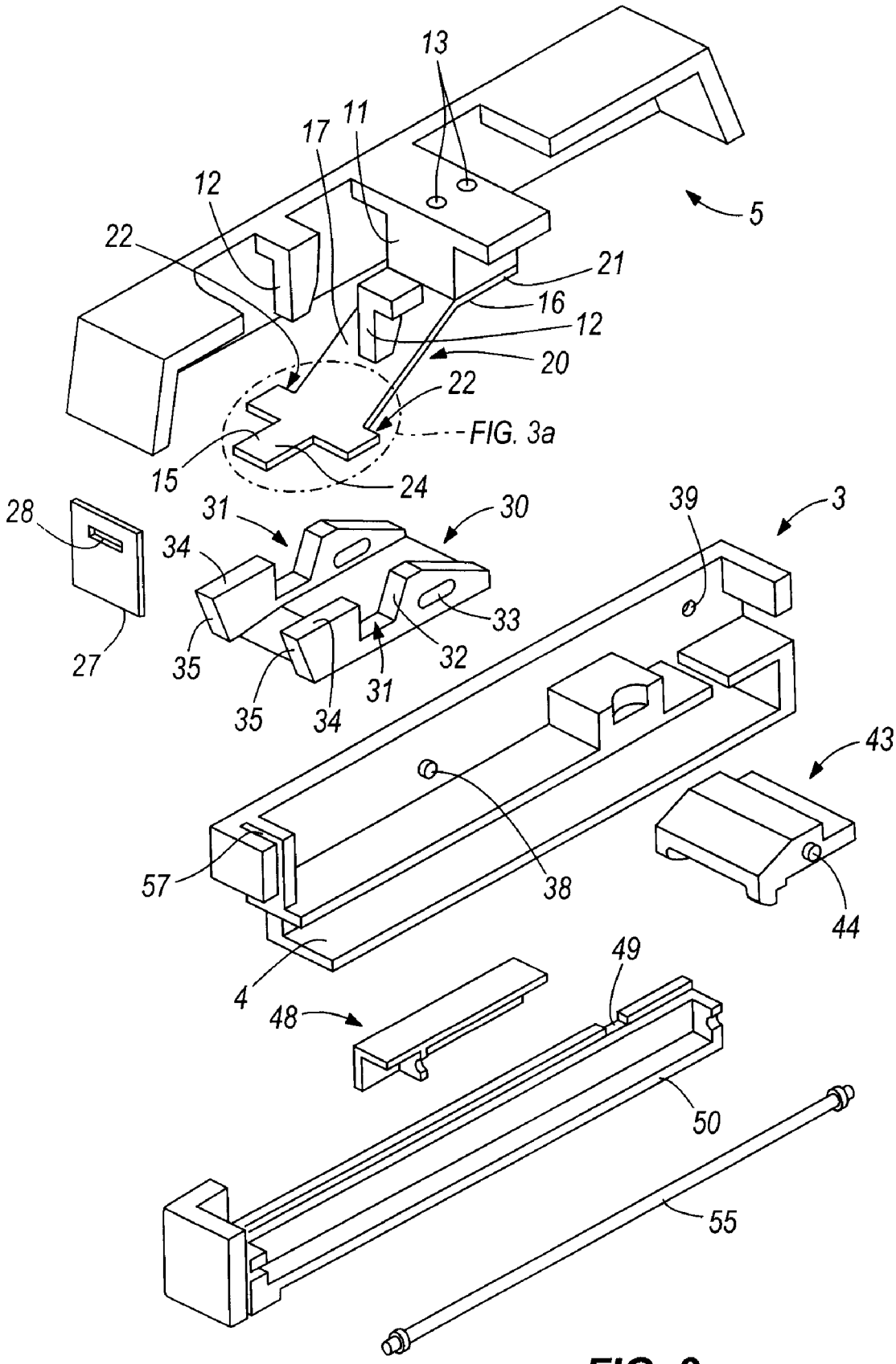
FIG. 3 is an exploded view of a portion of the stapler of FIG. 2.

FIG. 2 illustrates the internal configuration of the stapler 1 when the stapler 1 is not in operation. FIG. 3 is an exploded view that illustrates several of parts of the stapler 1. For clarity, FIG. 3 is a cross-sectional view along a longitudinal axis of the stapler 1 illustrating generally half of several parts of the stapler 1.

Referring to FIGS. 1-3, the illustrated stapler 1 further includes a cover biasing member 14 between the cover 5 and the frame 3 that biases the cover 5 away from the frame 3. While, the illustrated cover biasing member 14 is a coil spring, in other constructions the cover biasing member can be any suitable spring, such as torsion springs, leaf springs, and the like, or other suitable biasing members.

The illustrated cover 5 includes a trigger member 12 that extends from an inside surface of the cover 5. While the illustrated trigger member 12 includes two projections, in other constructions the trigger member can include only a single projection or may take other suitable forms. The cover 5 further includes a spring or elastic member receiver portion 11 that extends from the inside surface of the cover 5, adjacent the trigger member 12.

The stapler 1 further includes a driver member or elastic member 20, which is a leaf spring in the illustrated construction. The elastic member 20 is positioned between the cover 5 and the magazine 50. The elastic member 20 includes a first or free end portion 15, a second or fixed end portion 16, and a body portion 17 that extends between the free and fixed end portions 15, 16. The fixed end portion 16 of the illustrated elastic member 20 includes a substrate or base portion 21 that is utilized to couple the elastic member 20 to the receiver portion 11 of the cover 5. In the illustrated construction, the elastic member 20 is coupled to the cover 5 using fasteners that extend into apertures 13 formed in the cover 5. In other constructions, a slit can be provided in the receiver portion 11, or at any suitable location within the cover 5, and at least a portion of the base portion 21 of the elastic member 20 can be bent to form a tab such that the tab can be press-fitted into the slit of the cover. Such a tab and slit configuration construction can be used alone or in combination with fasteners and the apertures 13.

Figure 3A:
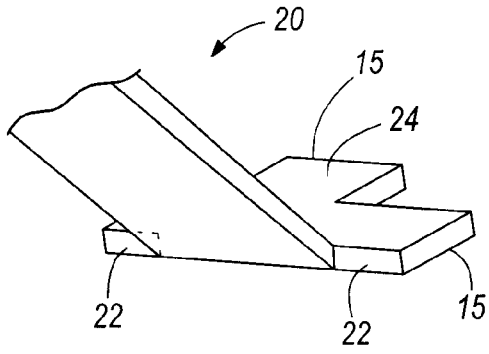
FIG. 3*a* is an enlarged view of an elastic member of the stapler illustrated in FIG. 3.

Referring to FIGS. 3 and 3*a*, the free end 15 of the elastic member 20 includes a blade engagement portion 24 and a slider or support member engagement portion 22 that extends in a lateral direction from the blade engagement portion 24 to form a T-shaped engagement portion of the elastic member 20 in the illustrated embodiment. A driver blade 27 is coupled to the elastic member 20 at the blade engagement portion 24. The blade engagement portion 24 of the elastic member 20 extends through a slit 28 formed in the driver blade 27 to couple or engage the elastic member 20 to the driver blade 27. The slit 28 of the driver blade 27 is sized such that the blade engagement portion 24 of the elastic member 20 is free to move with respect to the driver blade 27 in the forward and rearward directions.

Referring to FIG. 2, in the illustrated construction the elastic member 20 is a leaf spring. In other constructions, the elastic member 20 can be any suitable biasing member. The leaf spring defines an angle θ that is measured from the blade engagement portion 24 to the body portion 17 of the elastic member 20 with the stapler 1 in a resting or starting position (i.e., the cover 5 has not been pushed down). In the illustrated construction, the angle θ is approximately 160 degrees. In other constructions, the angle θ can be more or less than 160 degree depending on the application of the stapler 1. For example, if the stapler 1 is designed for relatively large staples and/or to staple through a relatively large amount of paper and the like, the angle θ can be less than 160 degrees.

Referring to FIGS. 2 and 3, the stapler 1 further includes a support member 30, which is a slider in the illustrated construction. The support member 30 includes cut out portions 31 that define trigger guide surfaces 32, and support surfaces 34 that slidably support the support member engagement portions 22 of the elastic member 20. The support member 30 further includes spring guide openings or slots 33 that extend transversely through the support member 30 and front tapered portions or surfaces 35 that are spaced a distance apart in order to engage the support member engagement portions 22 of the elastic member 20.

The illustrated support member 30 is coupled to the frame 3 using hubs or bosses 38 (only one visible in FIG. 3) that are received by the slots 33 of the support member 30. The illustrated support member 30 is able to slide with respect to the frame 3, and the slots 33 define the maximum forward and rearward positions of the support member 30 with respect to the frame 3. In the illustrated construction, the support member 30 slides is a direction generally parallel to a longitudinal axis 53 defined by the magazine 50 of the stapler 1. As best illustrated in FIG. 2, a biasing member 40, which is a coil spring in the illustrated construction, biases the support member 30 toward the front end 6 of the stapler 1.

Figure 5A:
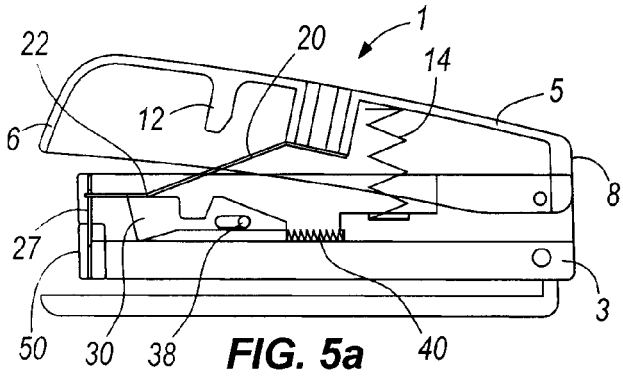
FIGS. 5*a*-5*e* illustrate the operation of the stapler of FIG. 1.
Figure 5A:
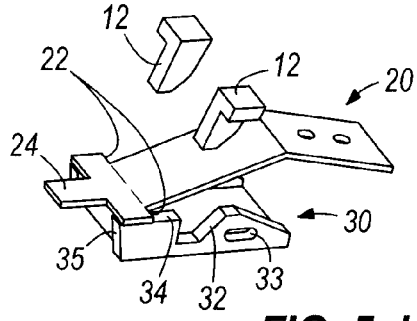

Referring to FIGS. 5*a* and 5*a*', when the stapler 1 is not in operation, the support member engagement portion 22 of the elastic member 20 is positioned on or above the spring gliding part or support surface 34 of the slider 30. Although the slider 30 moves with respect to the frame 3 in the forward and the rearward directions, the movement of the slider 30 is limited due to the engagement between the hub 38 of the frame 3 and the spring guide opening or slot 33 of the slider 30. Referring to FIG. 5*a*, the slider spring or biasing member 40 moves or biases the slider 30 in the forward direction (i.e. toward the front end 6 of the stapler 1).

Figure 4:
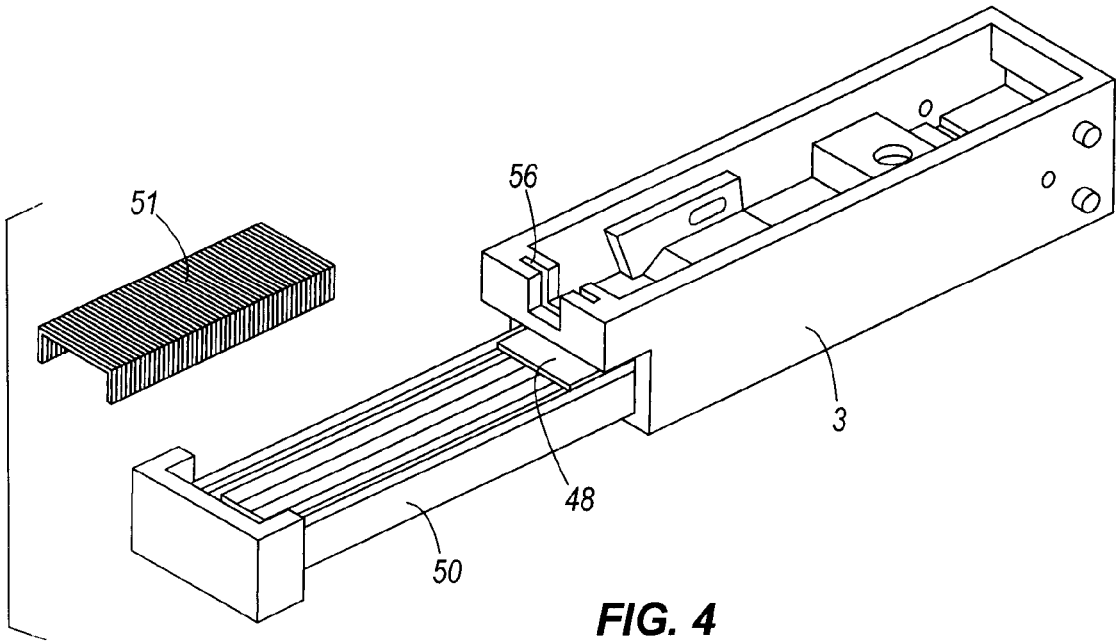
FIG. 4 is a perspective view of a staple magazine of the stapler of FIG. 1 when the magazine of the stapler is pulled out.

Referring to FIGS. 2-4, the stapler 1 includes the magazine 50 that is housed in the area 4 of the frame 3. The magazine 50 stores or houses staples 51. The magazine 50 is located with respect to the frame 3 such that a driver blade slot 56 formed in the magazine 50 is aligned with a driver blade slot 57 formed in the frame 3. The drive blade slots 56, 57 of the magazine 50 and the frame 3 are aligned such that the driver blade 27 can pass freely through both of the slots 56, 57.

Referring to FIG. 3, the illustrated magazine 50 includes a feeder or staple pusher 48 and a guide rod 55. The staple pusher 48 moves along the guide rod 55 to move or push staples 51 toward the front end 6 of the stapler 1. While not illustrated, the magazine 50 can include a biasing member, such as a coil spring disposed around the guide rod 55 and coupled to the guide rod 55 and staple pusher 48 to bias the staple pusher 48 toward the front end 6 of the stapler 1. Other configurations can also be used to bias the staple pusher 48 toward the front end 6.

The magazine 50 further includes a hook or latch 43 and a cut out 49. The latch 43 includes mounting bosses 44 (only one visible in FIG. 3) that couple the latch 43 to the frame 3 using the apertures 39 (only one visible in FIG. 3) formed within the frame 3. The bosses 39, 43 facilitate a pivoting connection of the latch 43 to the frame 3. While not illustrated a biasing member, such as a spring, can be used to bias the latch 43 into an engaged position, such that the latch 43 is engaged with the cut out 49.

While not illustrated, the magazine 50 further includes a magazine biasing member, such as a spring, that biases magazine 50 toward an open position (FIG. 11) or from the rear end 8 of the stapler 1 toward the front end 6. By disengaging the latch 43 from the cut out 49, it is possible to draw out or eject the magazine 50 forward for reloading staples 51 into the magazine 50 (FIG. 4). The user can disengage the latch 43 from the cut out 49 with a button, lever, or other suitable actuator interconnected to latch 43. In other constructions, the stapler 1 can be configured such that user can depress or push a rear portion of the latch 43 to eject the magazine 50 from the frame 3.

Figure 5B:
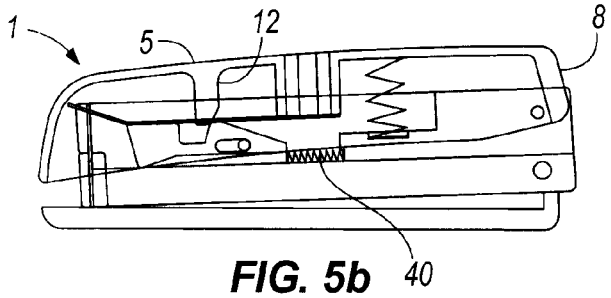
Figure 5B:
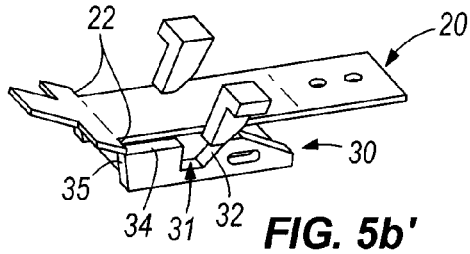
Figure 5C:
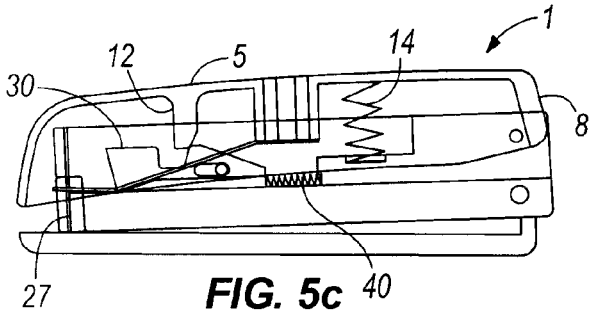
Figure 5C:
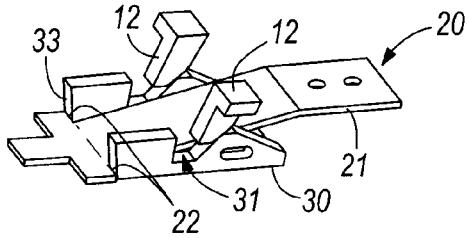
Figure 6:
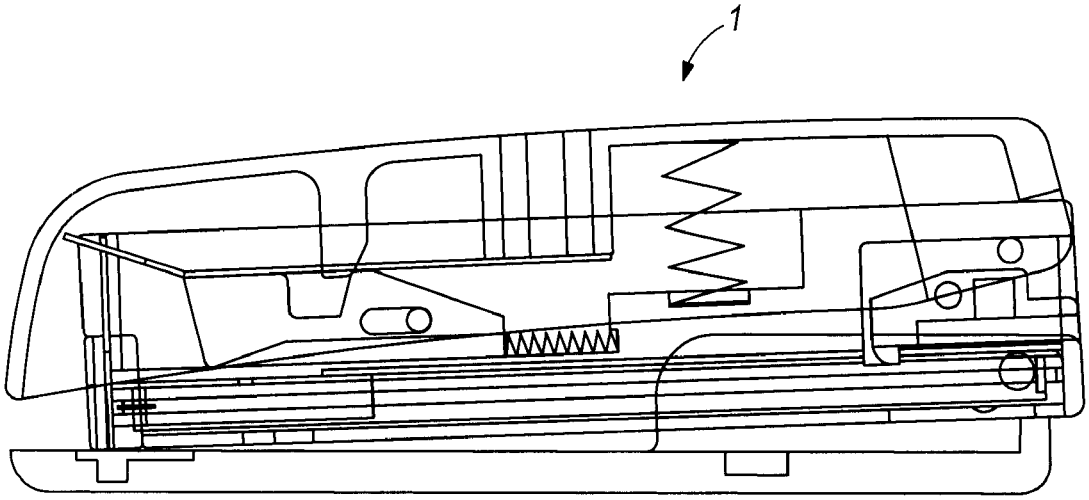
FIG. 6 illustrates the internal configuration of the stapler of FIG. 1 when the stapler is being operated just before a staple is driven from the stapler.
Figure 7:
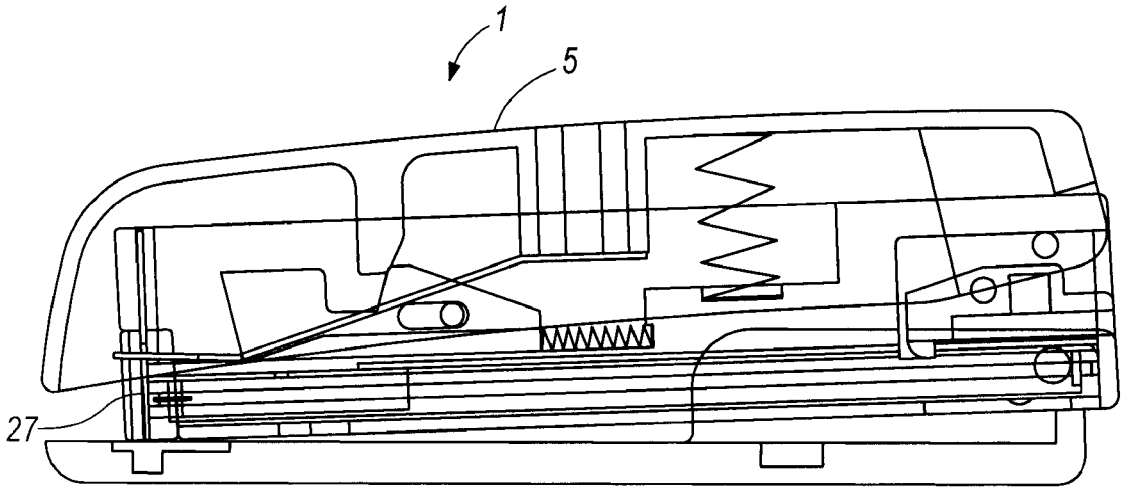
FIG. 7 illustrates the internal configuration of the stapler of FIG. 1 when the stapler is being operated after the staple is driven from the stapler.
Figure 8:
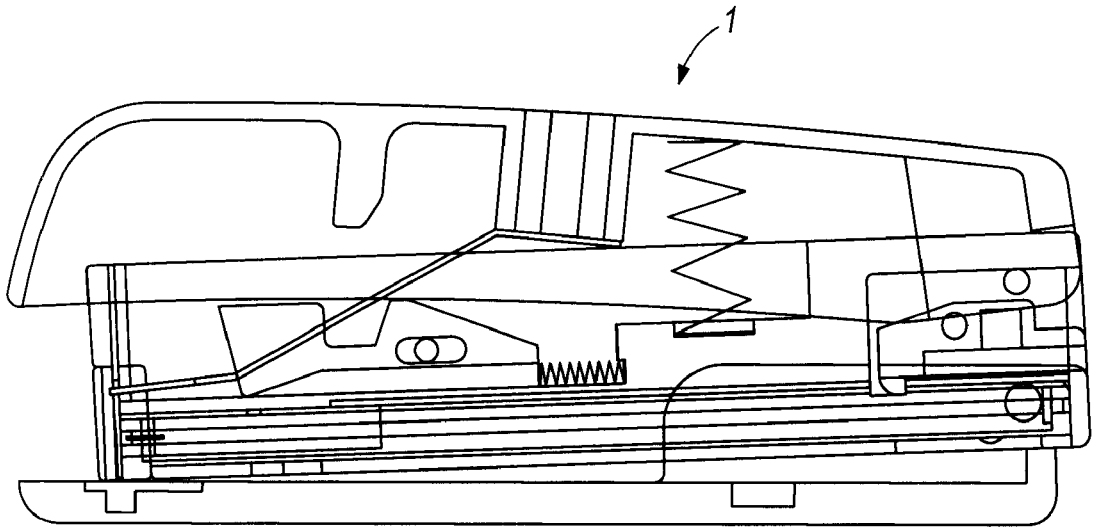
FIG. 8 illustrates the internal configuration of the stapler of FIG. 1 when the stapler is being operated as the cover begins to rise with respect to the staple magazine.
Figure 9:
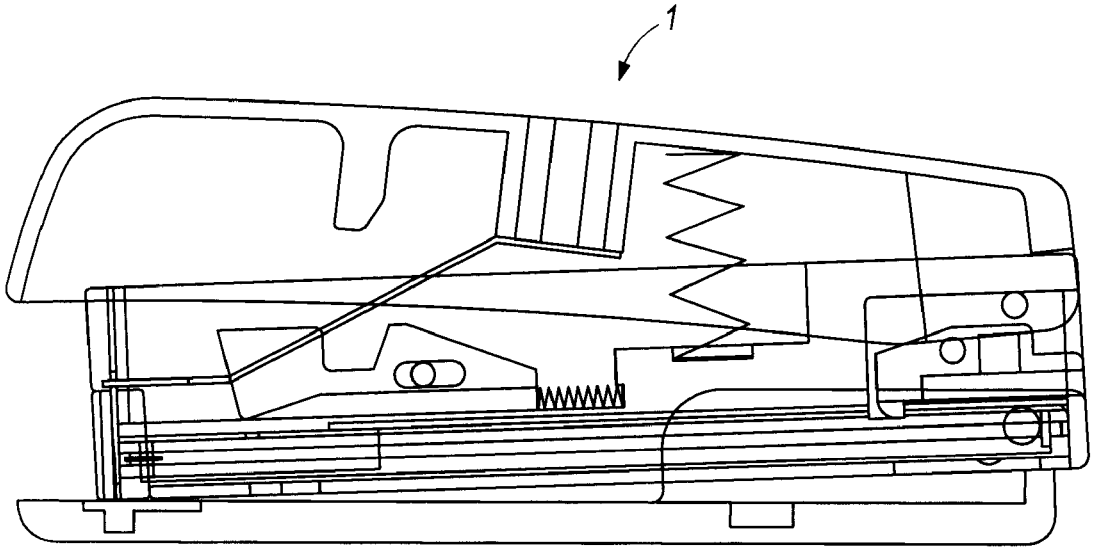
FIG. 9 illustrates the internal configuration of the stapler of FIG. 1 when the stapler is being operated as the cover continues to rise with respect to the staple magazine.
Figure 10:
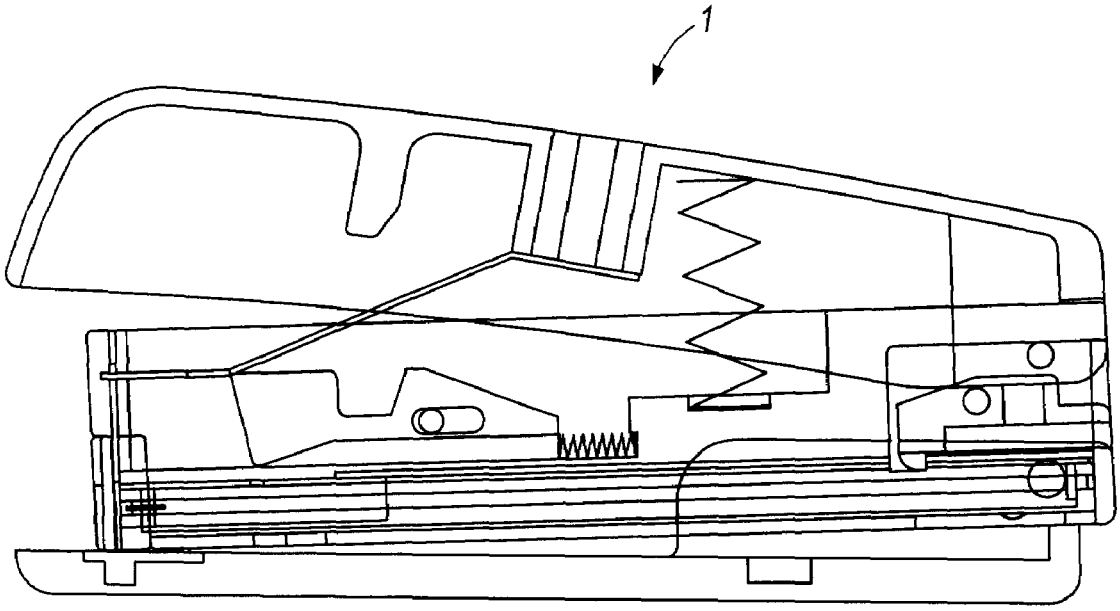
FIG. 10 illustrates the internal configuration of the stapler of FIG. 1 when the stapler has returned to the rest or start position.
Figure 11:
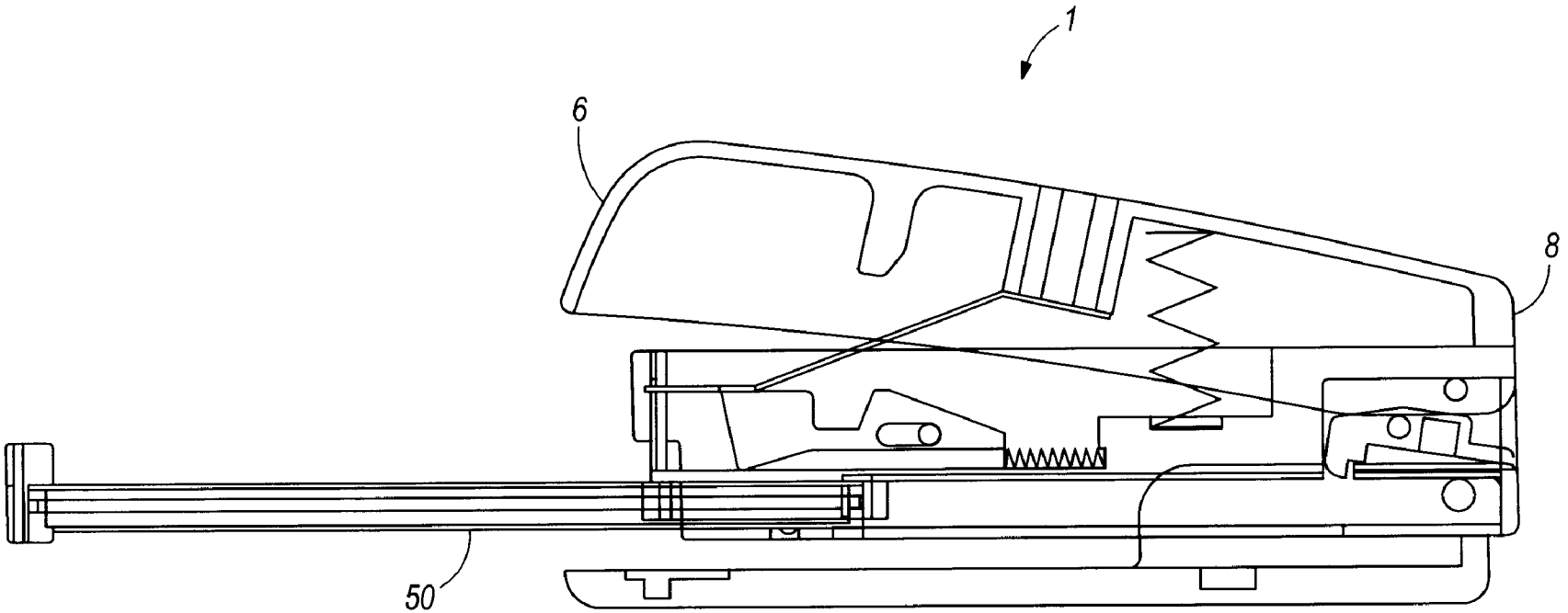
FIG. 11 illustrates the inner configuration of the stapler of FIG. 1 when the magazine of the stapler is pulled out to extend from the stapler

FIGS. 5*a*-5*c* illustrate the operation of the stapler 1 and the passage or ejection of the staples 51 (FIG. 4). By pushing the cover 5 downward, toward the magazine 50, the stapler 1 is operated in the order illustrated in the order FIG. 5*a*→FIG. 5*b*→FIG. 5*c*. The stapling operation is completed when the state shown in FIG. 5*c* is reached. To continue, when the user stops pushing the cover 5 downward, the stapler 1 returns to the state that existed (i.e., original or starting position) before stapling by carrying out the operations illustrated in the order FIG. 5*d*→FIG. 5*e*→FIG. 5*a*. The engagement of the elastic member 20, the support member 30 and the trigger member 12 is shown in the steps illustrated in FIG. 5*a*'-FIG. 5*e*'. Details of the position illustrated in FIG. 5*a* are shown in FIG. 2 while the details of the position illustrated in FIG. 5*b* are shown in FIG. 6. FIGS. 7, 9 and 10 indicate the details of the positions illustrated in FIGS. 5*c*, 5*d* and 5*e* respectively.

As illustrated in FIGS. 5*a* and 5*a*', when the user starts to push the cover 5 downward, toward the magazine 50, the engagement portion 22 of the elastic member 20 is in contact with the top surface or support surface 34 of the support member 30. When the cover 5 is pushed down further, the angle θ (FIG. 2) between the blade engagement portion 24 and the body portion 17 of the elastic member 20 is opened or the angle θ increases and the engagement portion 22 of the elastic member 20 moves forward along the support surface 34 of the support member 30.

As illustrated in FIGS. 5*b* and 5*b*', if the cover 5 is pushed further down, the engagement portion 22 of the elastic member 20 will slide along the support surface 34 of the support member 30 right up to the front edge of the support surface 34.

At this time, a large amount of force or energy to return to the original state (FIG. 5*a*) is accumulated in the elastic member 20.

As illustrated in FIGS. 5*c* and 5*c*', should the cover 5 be pushed further down, the engagement portion 22 of the elastic member 20 will fall downward after detaching or disengaging from the support surface 34 of the support member 30. In the illustrated construction, the elastic member 20 passes through a portion of the support member 30 between upstanding portions that define the support surfaces 34. When the engagement portion 22 of the elastic member 20 disengages the support surface 34 of the support member 30, the driver blade 27 that is engaged with blade engagement portion 24 of the elastic member 20 is driven downward. The force that is accumulated in the elastic member 20 will be released instantly and the force driving the blade 27 will be sufficient to drive the staples effectively.

As illustrated in FIG. 5*b* and 5*b*' and in FIG. 5*c* and 5*c*', the trigger member 12 is lowered along with the cover 5, and the trigger member 12 is engaged with the trigger guide 32 while the trigger member 12 is fed into the cut out 31 of the support member 30. The trigger member 12 contacts the trigger guide surfaces 32 of the support member 30 and guides or pushes the support member 30 backward while the cover 5 moves down. In the illustrated construction, when the trigger member 12 contacts the support member 30 the user continues to push down on the cover 5 to overcome the force of the biasing member 40 to slide the support member 30 toward the rear end 8 of the stapler 1.

The trigger 12 facilitates disengaging the engagement portion 22 of the elastic member 20 from the tip or front edge of the support member 30. In other words, since the elastic member 20 is a plate or leaf spring, there is a small amount of bending of the elastic member 20 based on the timing or speed of the stapling action. Due to this bending, the distance from the base 21 of the elastic member 20 to the engagement portion 22 becomes shorter causing cases when the disengagement of the engagement portion 22 with the support member 30 does not occur properly. The support member 30 is then pushed backward or toward the rear end 8 of the stapler 1 by the trigger member 12 to ensure that the engagement portion 22 of the elastic member 20 is disengaged from the support member 30 and that the driver blade 27 falls.

FIGS. 5*c* and 7 illustrate the cover 5 of the stapler 1 in the furthest downward (i.e., lowered) position. As illustrated in FIGS. 5*a*-5*c*, as the cover 5 travels from the starting position (FIG. 5*a*) to the lowered position (FIG. 5*c*), the elastic member 20 extends through the slit 28 in the driver blade 27 (FIG. 3) to remain in continuous contact with the driver blade 27.

As illustrated in FIGS. 5*c* and 7, in the illustrated construction, the cover 5 does not contact the driver blade 27 when the cover 5 is in the lowered position. Therefore, when the cover 5 is the lowered position, the cover 5 generally does not tend to push the driver blade 27 further downward. Thus, the maximum achievable stapling power of the stapler 1 is generated by the elastic member 20, and the user cannot push down further or harder on the cover 5 to force the driver blade 27 down further.

After stapling, when the force used to push the cover 5 is released, the cover 5 returns to the original position (FIG. 5*a*) by rising immediately with the help of the cover biasing member 14. As shown in FIG. 5*c*', in the illustrated construction, the trigger member 12 and the support member 30 are engaged only above the cut out 31 of the support member 30 when the cover 5 is in the lowered position. As the cover 5 rises, disengagement between the trigger member 12 and the support member 30 can take place easily and there is no longer any impact of the trigger member 12 on the support member 30.

Figure 5D:
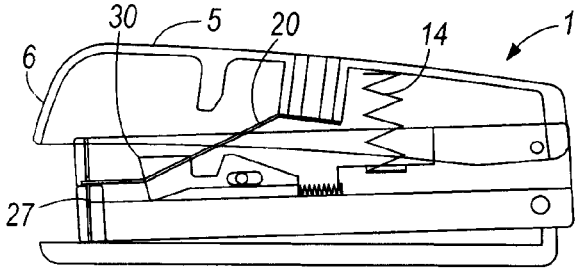
Figure 5D:
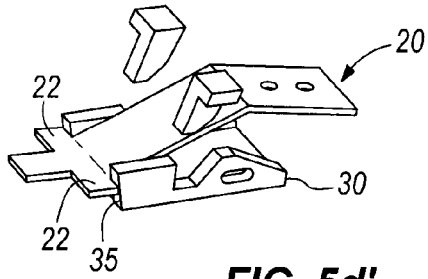

As illustrated in FIGS. 5*d* and 5*d*', as the cover biasing member 14 raises the cover 5, the engagement portion 22 of the elastic member 20 rises upward and is guided by the front taper portions 35 of the support member 30. At this time, the spring force of the cover biasing member 14, which forces the cover 5 and elastic member 20 to rise, is greater than the spring force of the biasing member 40 of the support member 30 that biases the support member 30 toward the front end 6 of the stapler 1. Because the front taper 35 angles forward, as the elastic member 20 rises, the engagement portion 22 not only slides along the front taper 35 of the support member 30, but also guides or pushes the support member 30 backward or toward the rear end 8 of the stapler 1.

Figure 5E:
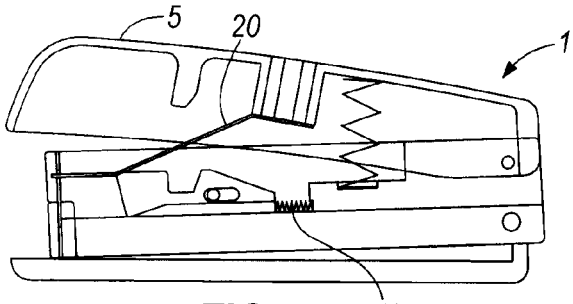
Figure 5E:
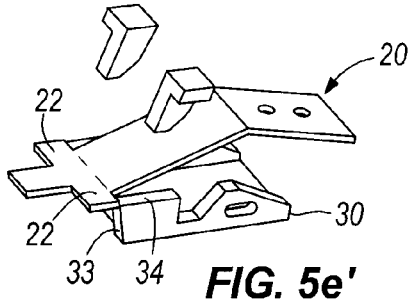

As illustrated in FIGS. 5*e* and 5*e*', as the cover 5 and the elastic member 20 rise further, the engagement portion 22 of the elastic member 20 reaches the peak of the front taper portions 35 of the support member 30. When the cover 5 and elastic member 20 rise slightly more, the engagement portion 22 is detached from the front taper portion 35 of the support member 30 and the engagement portion 22 of the elastic member 20 re-engages with the support surface 34 of the support member 30. When the engagement portion 22 is detached from the front taper portion 35 of the support member 30, the support member 30 is pushed forward by the biasing member 40 while the engagement portion 22 slides along the support surface 34 of the support member 30 to return the support member 30 and elastic member 20 to the original or starting position as illustrated in FIG. 5*a*.

Figure 12A:
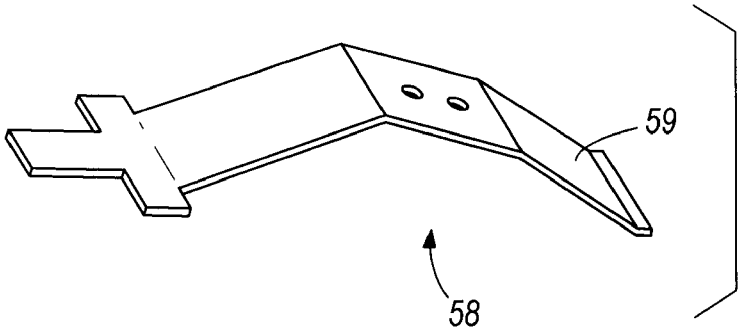
FIG. 12*a* illustrates the driver spring of the stapler of FIG. 12.
Figure 12:
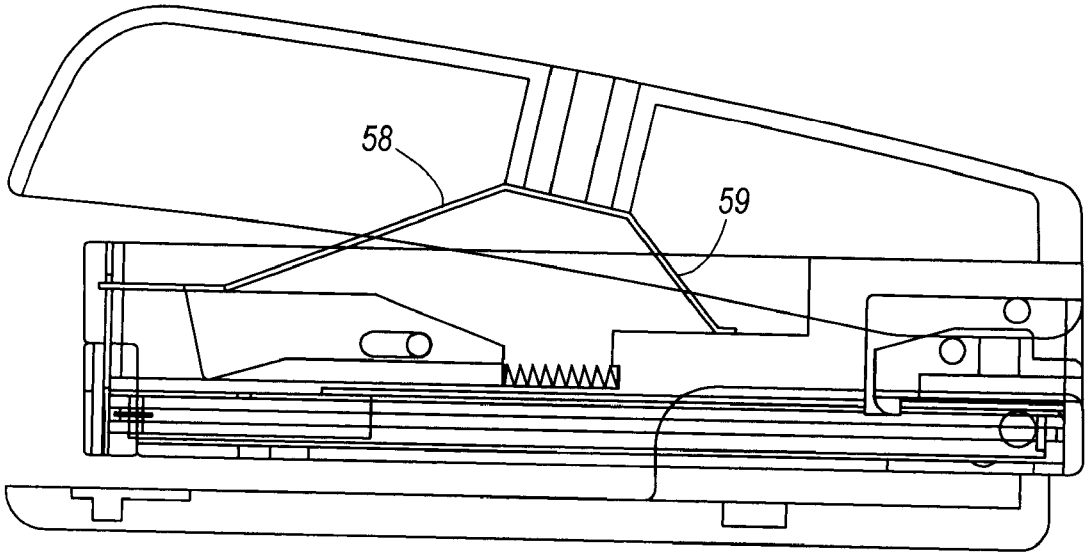
FIG. 12 is an alternative embodiment of the stapler of FIG. 1 illustrating the inner configuration of the stapler and a driver spring.

FIGS. 12 and 12*a* illustrate a second embodiment of the stapler. In the embodiment illustrated in FIG. 12, the elastic member 58 includes a rearwardly-extending plate spring portion 59 that functions as the cover biasing member (i.e., in place of the cover biasing member 14 of FIGS. 1-11). The illustrated plate spring portion 59 is integrally formed with the elastic member 58, however could be a separate piece. The other mechanisms of the stapler and operation of the stapler are similar to the first embodiment of FIGS. 1-11.

Figure 13A:
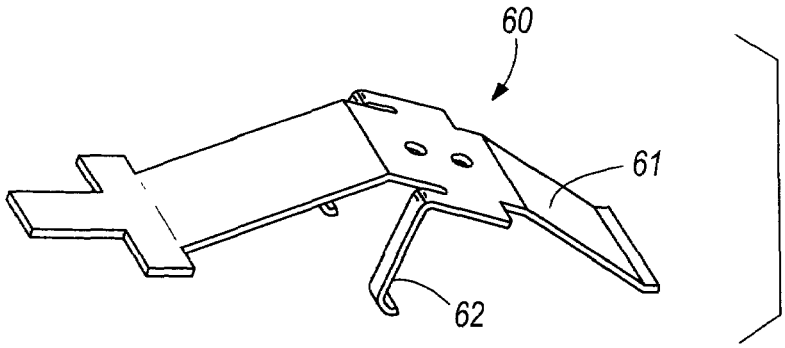
FIG. 13 is another alternative embodiment of the stapler of FIG. 1 illustrating the inner configuration of the stapler and a driver spring.
FIG. 13*b* illustrates the driver spring of the stapler of FIG. 13.
Figure 13:
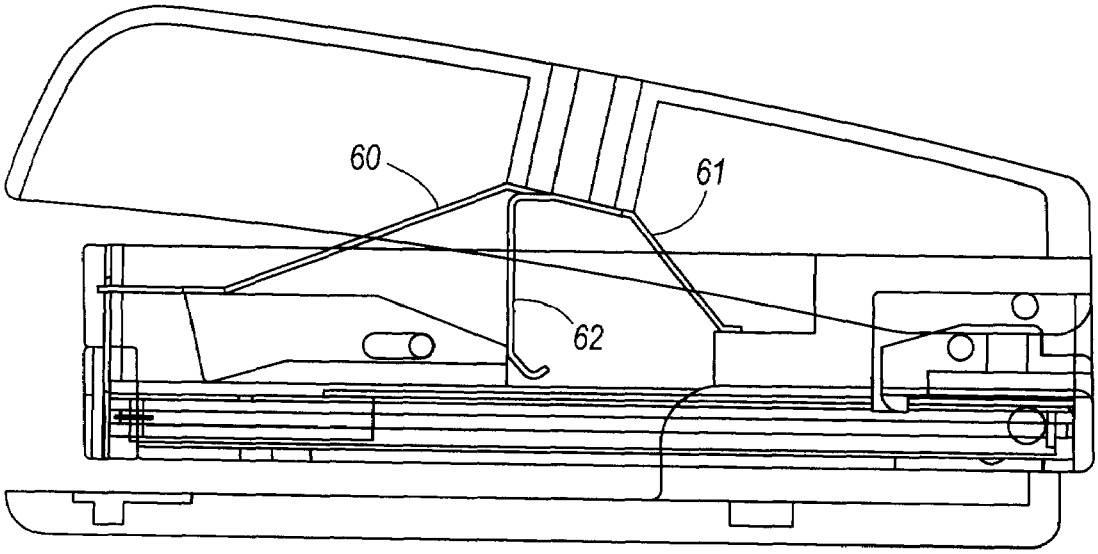

FIGS. 13 and 13*a* illustrate a third embodiment. The elastic member 60 includes a plate spring portion 61 that operates as the cover biasing member (i.e., in place of the cover biasing 14 of FIGS. 1-11). Furthermore, the elastic member 60 includes support member biasing members or slider springs 62 that can replace or supplement the biasing spring 40 of FIGS. 1-11. The illustrated slider springs 62 and plate spring 61 are integrally formed with the elastic member 60 but alternatively could be separate components. The other mechanisms of the stapler and operation of the stapler are similar to the first embodiment.

Figure 14:
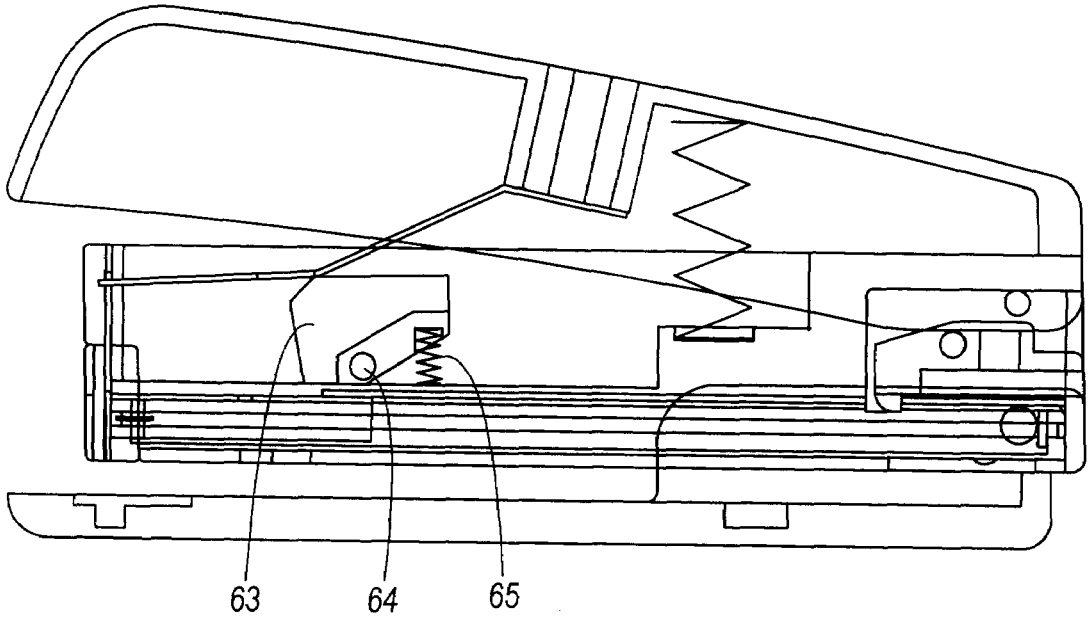
FIG. 14 is yet another alternative embodiment of the stapler of FIG. 1 illustrating the internal configuration of the stapler.

FIG. 14 illustrates a fourth embodiment in which the support member 30 is replaced by a cam 63 that guides the engagement part of the elastic member. The cam 63 rotates with the help of the cam spring 65 about the axis 64. The other mechanisms are similar to the first embodiment.

FIGS. 15-19 illustrate yet another alternative embodiment of the stapler 1 of FIGS. 1-11. The stapler 101 of FIGS. 15-19 is similar to the stapler 1 of FIGS. 1-11. Therefore, like components have been given like reference numbers in the one-hundred series, and only the general differences will be discussed below.

Figure 15:
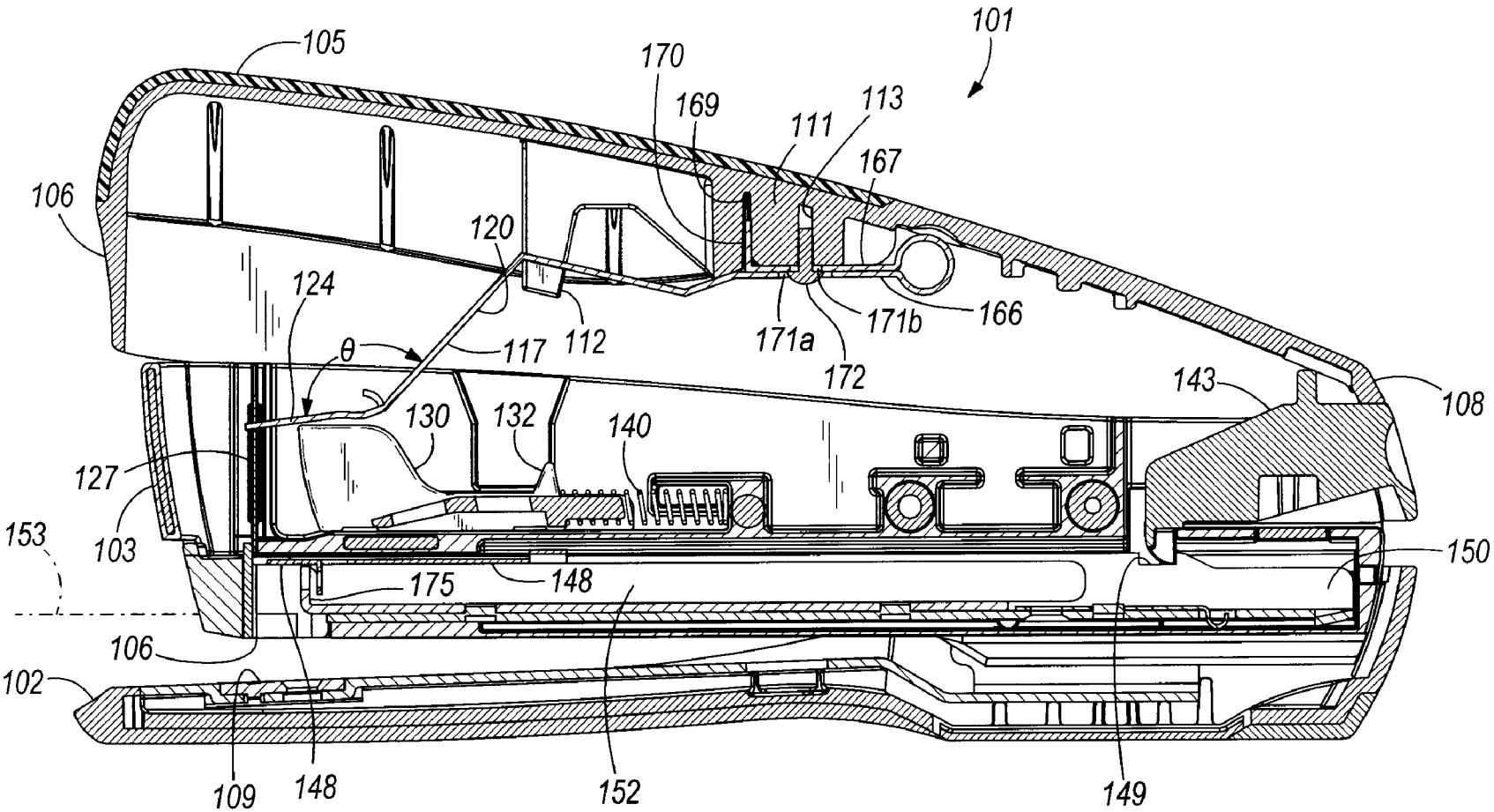
FIG. 15 is yet another alternative embodiment of the stapler of FIG. 1 illustrating the inner configuration of the stapler when the stapler is in the rest or start position.
Figure 16:
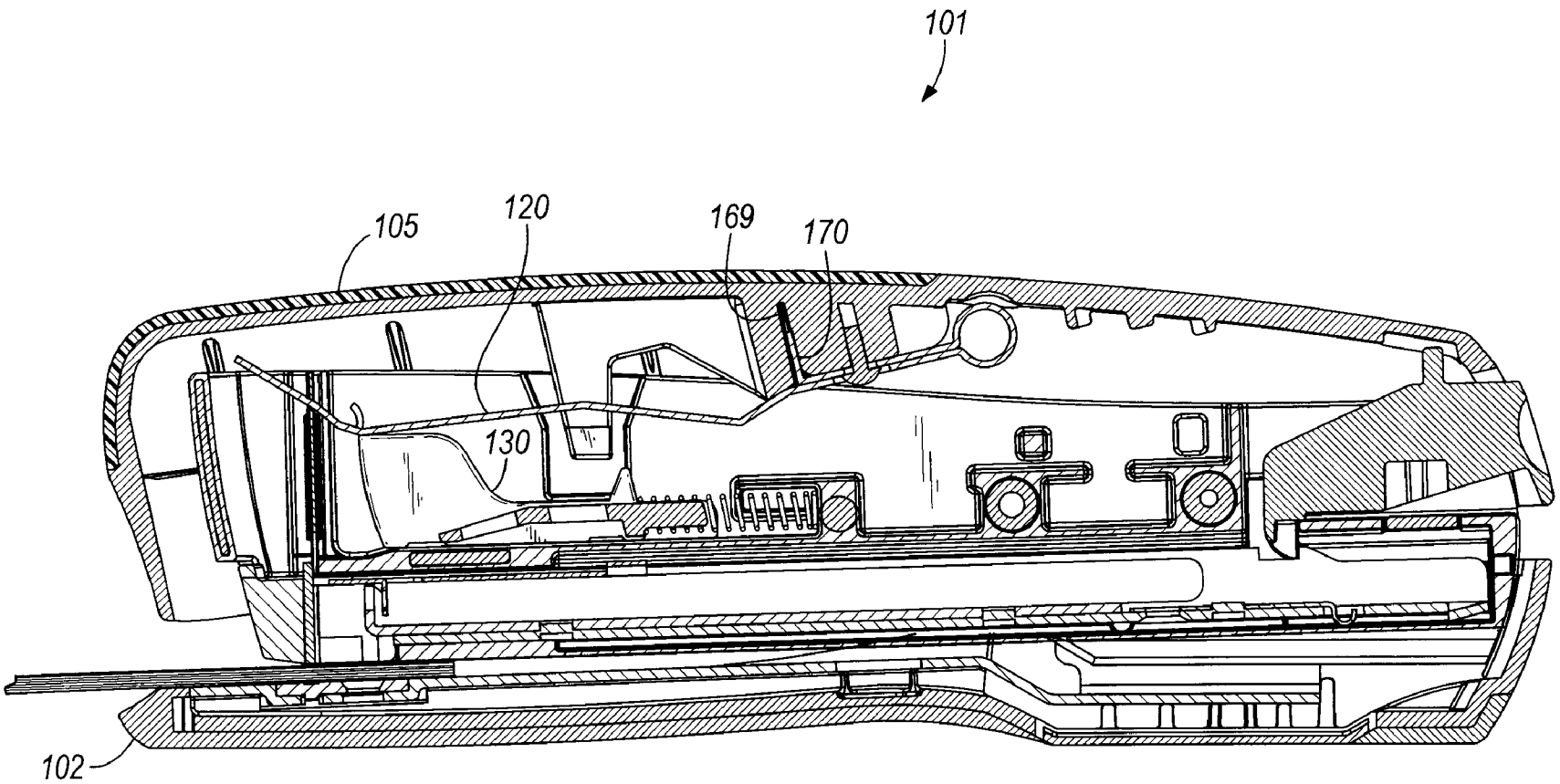
FIG. 16 illustrates the stapler of FIG. 15 when the stapler is being operated just before a staple is driven from the stapler.

FIG. 15 illustrates the stapler 101 that includes the base 102, the frame 103 coupled to the base 102, and the cover 105 that is coupled to the frame 103.

The elastic member 120 is positioned between the cover 105 and the magazine 150. The illustrated elastic member 120 defines the angle θ between the body portion 117 and the driver blade engagement portion 124 that is approximately 140 degrees. As discussed above, the angle θ can be virtually any angle depending on the application of the stapler 101, including the angle θ that is approximately 160 degrees as illustrated in the stapler 1 of FIGS. 1-11.

Figure 17:
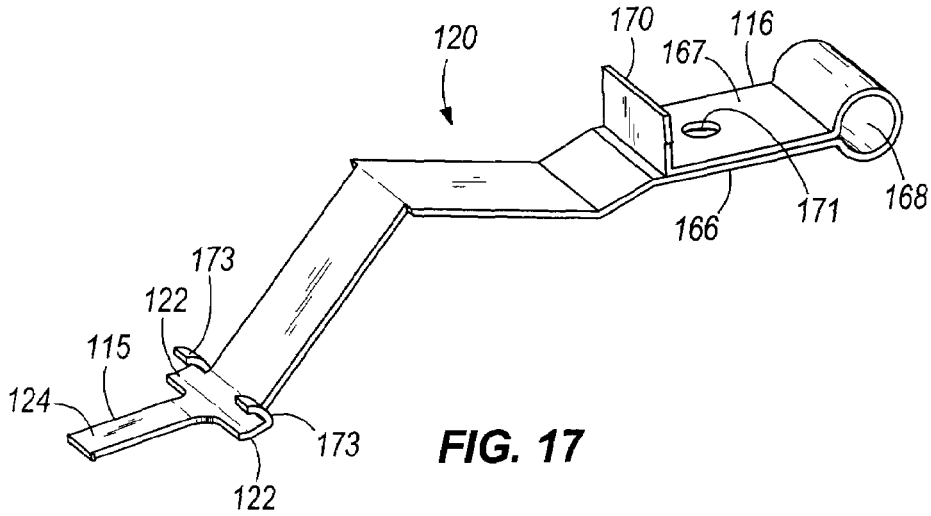
FIG. 17 illustrates an elastic member of the stapler of FIG. 15.

The elastic member 120 is illustrated in more detail in FIG. 17. The illustrated elastic member 120 is a leaf spring that includes the free or first end portion 115 and the fixed or second end portion 116. The second end portion 116 of the elastic member 120 includes a first layer 166 and a second layer 167. The first layer 166 and the second layer 167 are formed to define a loop 168. The illustrated first layer 167 of the elastic member 120 is bent generally upwards at one end to form a tab 170. The tab 170 is received within a slot 169 formed in the cover 105 to facilitate coupling the elastic member 120 to the cover 105.

Referring to FIGS. 15 and 17, the second end portion 116 of the illustrated elastic member 120 further includes an aperture 171 that extends through the elastic member 120. The aperture 171 receives a fastener 172 to couple the elastic member 120 to the cover 105. The illustrated aperture 171 includes a first aperture 171*a* formed through the first layer 166 and a second aperture 171*b* formed through the second layer 167 that is smaller than the first aperture 171*a* that extends through the first layer 166. The first and second apertures 171*a, b* are sized such that the second aperture 171*b* that extends through the second layer 167 is utilized to generally fix or secure the elastic member 120 to the cover 105 while the first aperture 171*a* that extends through the first layer 166 is larger than a head of the fastener 172. Therefore, the first aperture 171*a* and the first layer 166 are able to move with respect to the fastener 172 and the second layer 167. Such a configuration increases the effective length of the elastic member 120 as compared to the elastic member 20 of FIGS. 1-11 to include the first layer 166, the loop 168, and the portion of the second layer 167 between the loop 168 and the aperture 171*b*. However, it should be understood that any of the embodiments of the stapler described herein can include either the single layer elastic member or the dual layer elastic member.

Referring to FIG. 17, the first end portion 115 of the elastic member 120 includes the support member engagement portions 122. The illustrated support member engagement portions 122 define a generally T-shaped portion of the elastic member 120 and includes tabs 173 that are somewhat rounded. The tabs 173 facilitate sliding of the elastic member 120 along the front portions 135 of the support member 130 (FIG. 18).

Figure 18:
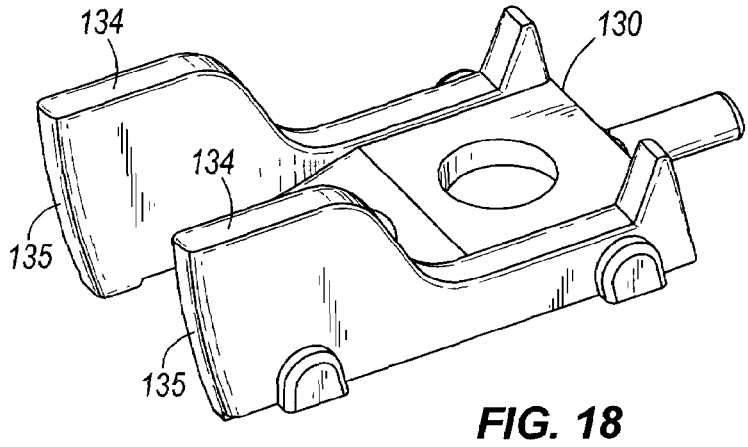
FIG. 18 illustrates a support member of the stapler of FIG. 15.

Referring to FIGS. 15 and 18, the stapler 101 further includes the support member 130 that supports the elastic member 120. Similar to the support member 30 of FIGS. 1-11, the illustrated support member 130 of FIGS. 15 and 18 is a slider movable in a direction parallel to the longitudinal axis 153 of the magazine 150. The illustrated support member 130 includes support surfaces 134 that support the elastic member 120 and front end portions 135 that are both tapered and radiused. The radius of the front end portions 120 has been found to more effectively allow the elastic member 120 to move along the front end portions 135 to return to the support surfaces 134 of the support member 130 as the cover 105 rises after stapling.

Figure 19:
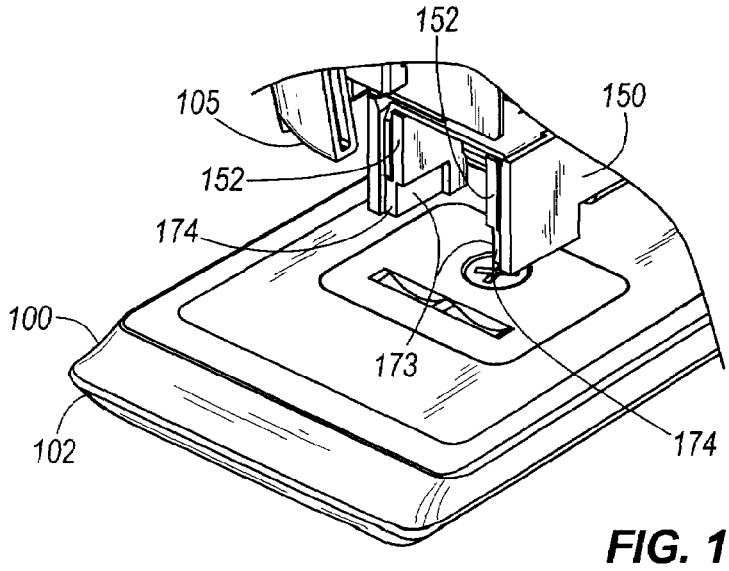
FIG. 19 is an enlarged view of a front portion of the stapler of FIG. 15 with a portion of the stapler removed.

Referring to FIG. 19, the illustrated magazine 150 of the stapler 101 includes the inner rails 152 that include swaged out end portions 173. The swaged out end portions 173 provide support surfaces 174 that stabilize or support the back of the staple when the staple is driven. The support surface 174 can be particularly beneficial for high speed and high sheet capacity staple driving applications.

Referring to FIG. 15, the magazine 150 further includes a boss 175 formed inside of the inner rails 152. The staple pusher 148, which is biased toward the driver blade 127, contacts the boss 175 when there are no staples remaining in the magazine in order to prevent the staple pusher 148 from being located directly underneath the driver blade 127. Therefore, if the user pushes the cover 105 to eject or push out a staple when there are no staples in the magazine 150, the driver blade 127 will pass into and through the magazine 150 without generally contacting the staple pusher 148. While the boss 175 is an upstanding flange, in other constructions the boss 175 can be any suitable member, such as a protrusion formed on the inside of the inner rail 152. Such a construction is illustrated in FIGS. 20-23.

Operation of the stapler 101 of FIGS. 15-19 is generally the same as the stapler 1 of FIGS. 1-11.

Figure 20:
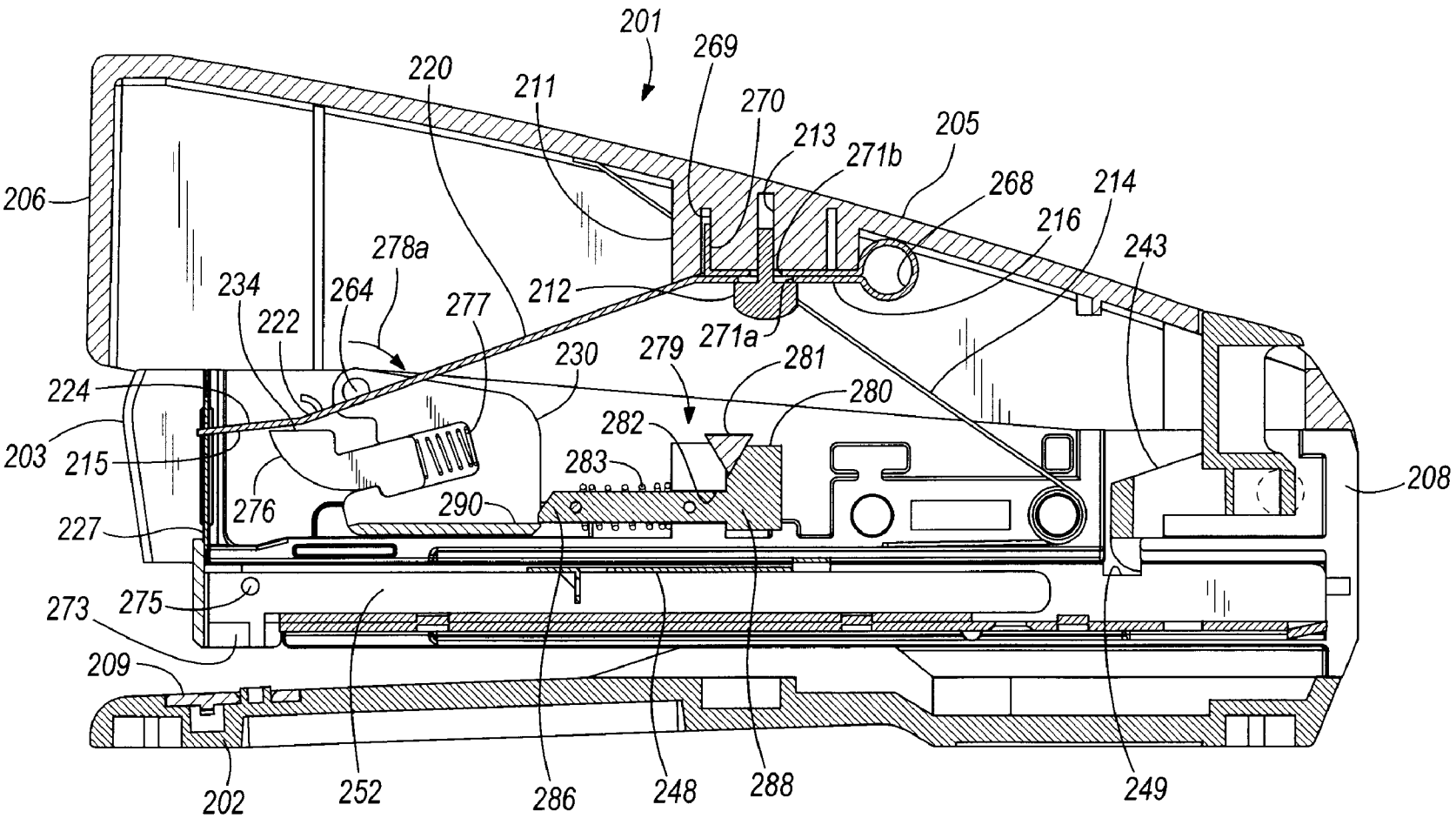
FIG. 20 is yet another alternative embodiment of the stapler of FIG. 1 illustrating the inner configuration of the stapler when the stapler is in the rest or starting position.
Figure 21:
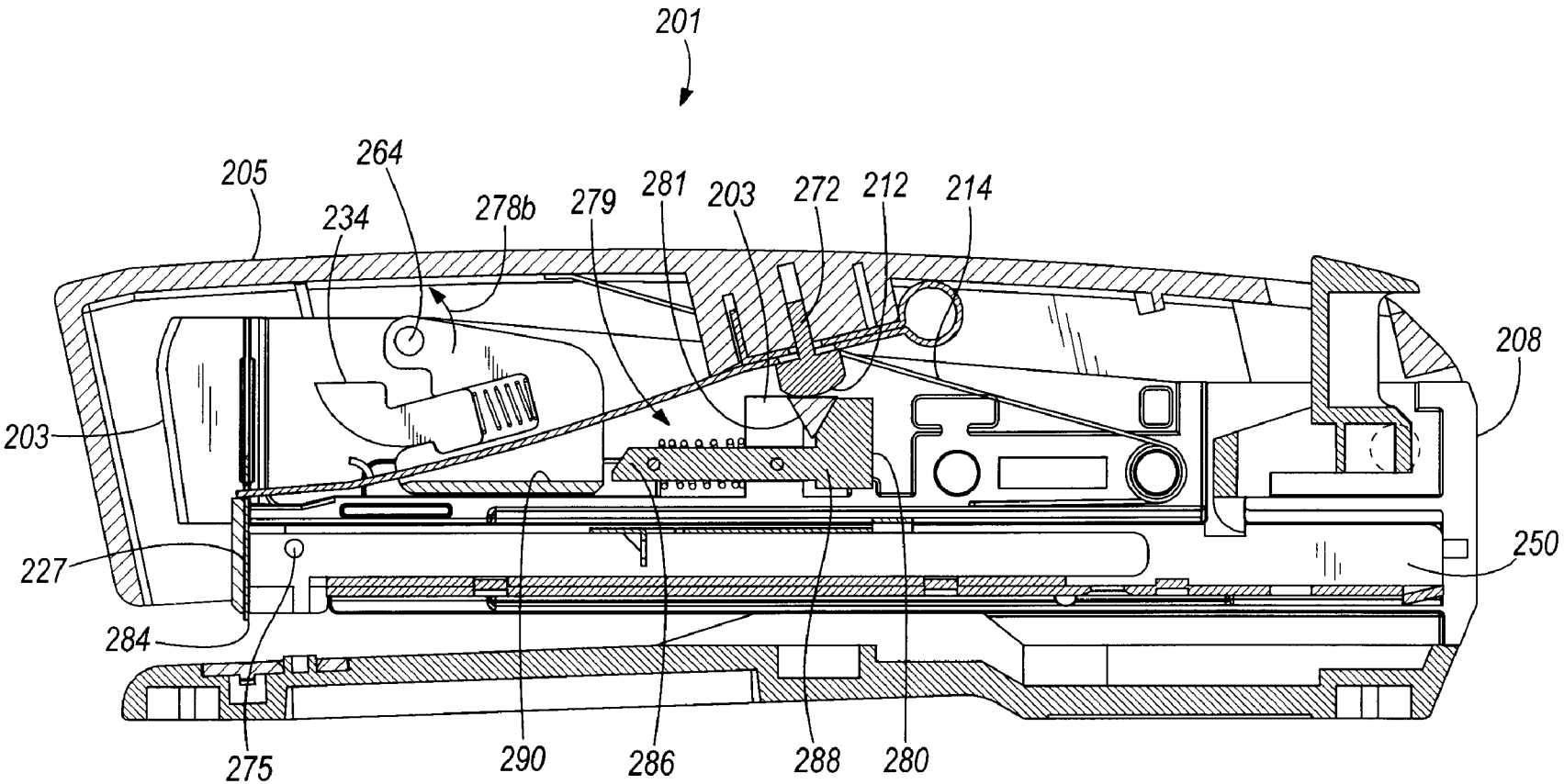
FIG. 21 illustrates the stapler of FIG. 20 when the stapler is being operated just after a staple has been driven from the stapler.
Figure 22:
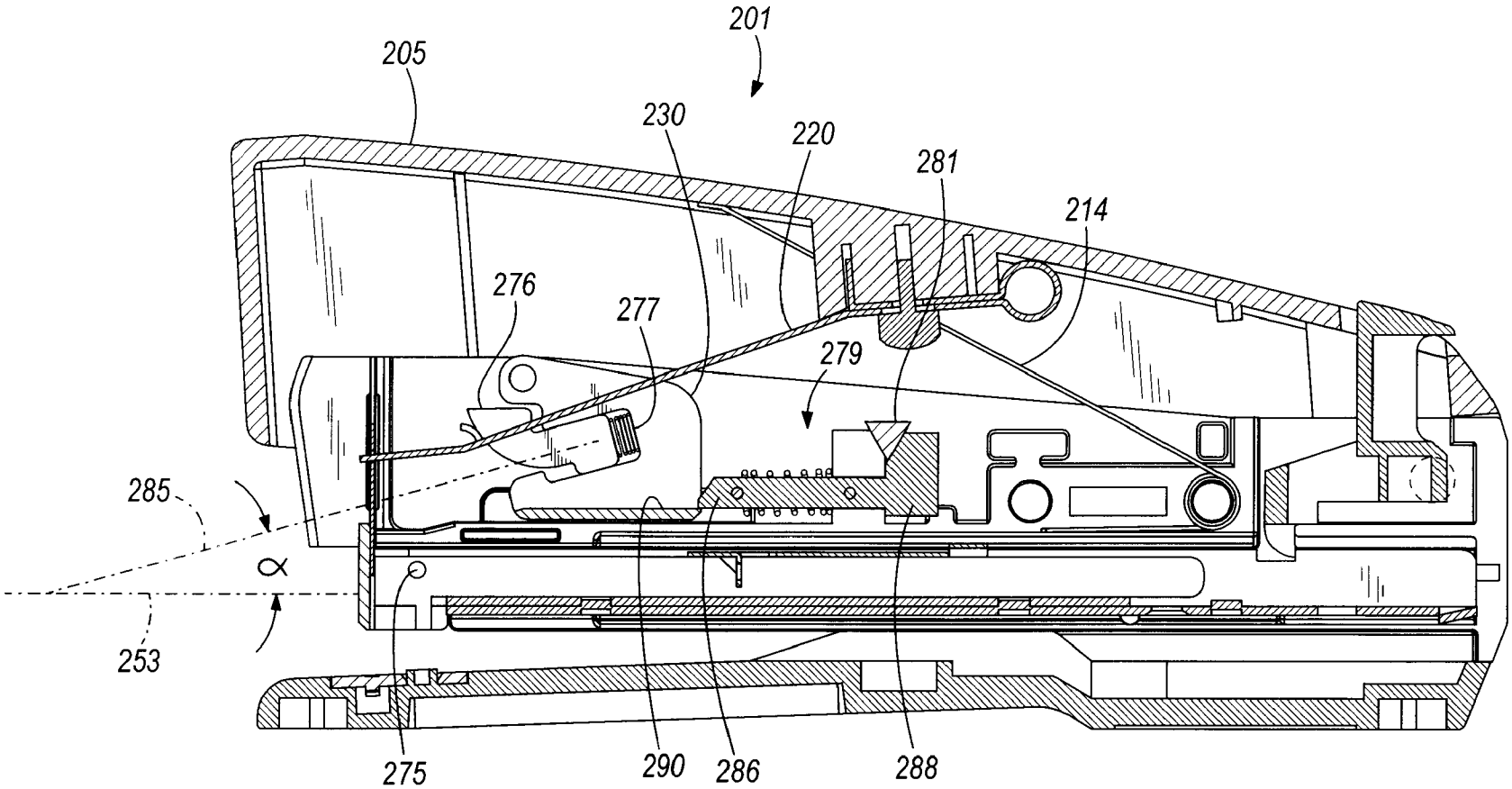
FIG. 22 illustrates the stapler of FIG. 20 when the stapler is being operated as the cover rises back to the starting position.

FIGS. 20-22 illustrate yet another alternative embodiment of the stapler 1 of FIGS. 1-11. The stapler 201 of FIGS. 20-22 is similar to the stapler 1 of FIGS. 1-11. Therefore, like components have been given like reference numbers in the two-hundred series, and only the general differences will be discussed below.

Referring to FIG. 20, the illustrated cover biasing member 214 of the stapler 201 is a torsion spring that contacts the cover 205 at a position closer to the front end 206 of the stapler 201 than the cover biasing member 14 of the stapler 1 of FIGS. 1-11. Increasing the distance from the point that the cover biasing member 214 contacts the cover 205 to the point about which the cover rotates increase the effective length of a lever created between the point that the cover biasing member 214 contacts the cover 205 to the point about which the cover 205 rotates. As understood by one of skill in the art, the longer lever reduces the spring force needed to raise the cover 205.

The support member 230 of the stapler 201 is a cam that pivots or rotates about the axis 264. The illustrated support member 230 includes a slider member 276 and a biasing member 277 between the support member 230 and the slider member 276. The biasing member 277 biases the slider member 276 toward the front end 206 of the stapler 201. While the illustrated biasing member 277 is a coil spring, it should be understood that the biasing member can be any suitable biasing member, such as other types of springs, an elastomer, and the like.

While not visible in FIG. 20, the stapler 201 includes a support member biasing member that biases the support member 230 about the axis 264 in the direction indicated by an arrow 278*a*. The support biasing member can be a torsion spring or other suitable devices.

The stapler 201 further includes a support member release mechanism 279. The illustrated support member release mechanism 279 includes a release member 280 and an activation member 281. The illustrated release member 280 includes an elongated portion 286 that extends through an aperture 282 formed in the frame 203 and an enlarged portion 288 formed on an end of the elongated portion 286. The activation member 281 is located between the frame 203 and the enlarged portion 288 of the release member 280, and in the illustrated embodiment has a wedge-shaped configuration. A biasing member 283, which is a coil spring in the illustrated construction, surrounds a portion of the elongated portion 286 of the release member 280 and biases the release member 280 toward the front end 206 of the stapler 1, into engagement with the support member 230.

The illustrated support member 230 includes a release member engagement portion 290. The engagement portion 290 engages the elongated portion 286 of the release member 280 to retain the support member 230 in the position illustrated in FIG. 20. While the release member engagement portion 290 of the support member 230 is a ledge portion of the support member 230, in other constructions the engagement portion 290 can be any suitable member, such as an aperture, surface, and the like.

The operation of the stapler 201 is generally the same as the operation of the stapler 1, discussed above. Therefore, only the general differences in the operation will be discussed below.

FIG. 20 illustrates the stapler 201 in the starting or original position when the stapler 201 is not being used. As discussed above with regard to FIGS. 5*a*-5*c*, as the user pushes down on the cover 205, the engagement portion 222 of the elastic member 220 moves forward or toward the front end 206 of the stapler 201. Eventually the elastic member 220 will move far enough forward that the elastic member 220 disengages from the support surface 234 of the support member 230, or the trigger mechanism 212, which is a cam in the illustrated construction, will activate the support member release mechanism 279 to release the support member 230 to ensure that the driver blade 229 and elastic member 230 will fall and drive a staple (FIG. 21).

Referring to FIG. 21, in the illustrated construction, when cover 205 is pushed down far enough the trigger member 212 contacts the activation member 281 of the support member release mechanism 279. As the cover 205 is pushed down even farther the trigger member 212 pushes the activation member 281 downward between the frame 203 and the enlarged portion 288 of the release member 280 causing the release member 280 to slide toward the rear end 208 of the stapler 201. As illustrated in FIG. 21, when the elongated portion 286 of the release member 280 moves rearward to a predetermined point, the release member 280 is removed from contact with the engagement portion 290 (e.g., an aperture, surface, etc.) of support member 230. With the release member 280 no longer contacting the support member 230, the support member 230 is free to rotate about the axis 264. The downward force of the elastic member 220 acting on the slider 276 of the support member 230 (FIG. 20) rotates the support member 230 about the axis 264 in the direction indicated by the arrow 278*b*, thereby ensuring that the elastic member 220 and the driver blade 229 will fall and push a staple from the magazine 250.

As illustrated in FIG. 21, the illustrated stapler 201 is constructed such that a portion 284 of the driver blade 227 extends from the magazine 250 after the driver blade 227 has been lowered to drive a staple. While only the stapler 201 of FIGS. 20-22 has been shown with the portion 275 extending from the magazine 250 after the driver blade 227 has been lowered, it should be understood that any of the staplers described herein can include such a feature.

As illustrated in FIG. 22, the slider 276 of the support member 230 facilitates returning the elastic member 220 to its starting or original position. As the cover biasing member 214 forces the cover 205 and elastic member 220 upward, the cover biasing member 214 overcomes the force of the slider biasing member 277 and the elastic member 230 forces the slider 276 to slide into the support member 230 along a slider axis 285. The support member 230 is constructed such that the slider axis 285 is positioned at an angle $\alpha$ with respect to the magazine axis 253. In the illustrated construction, the angle $\alpha$ is approximately 20 degrees and in other constructions, the angle $\alpha$ can be any suitable angle.

Figure 23:
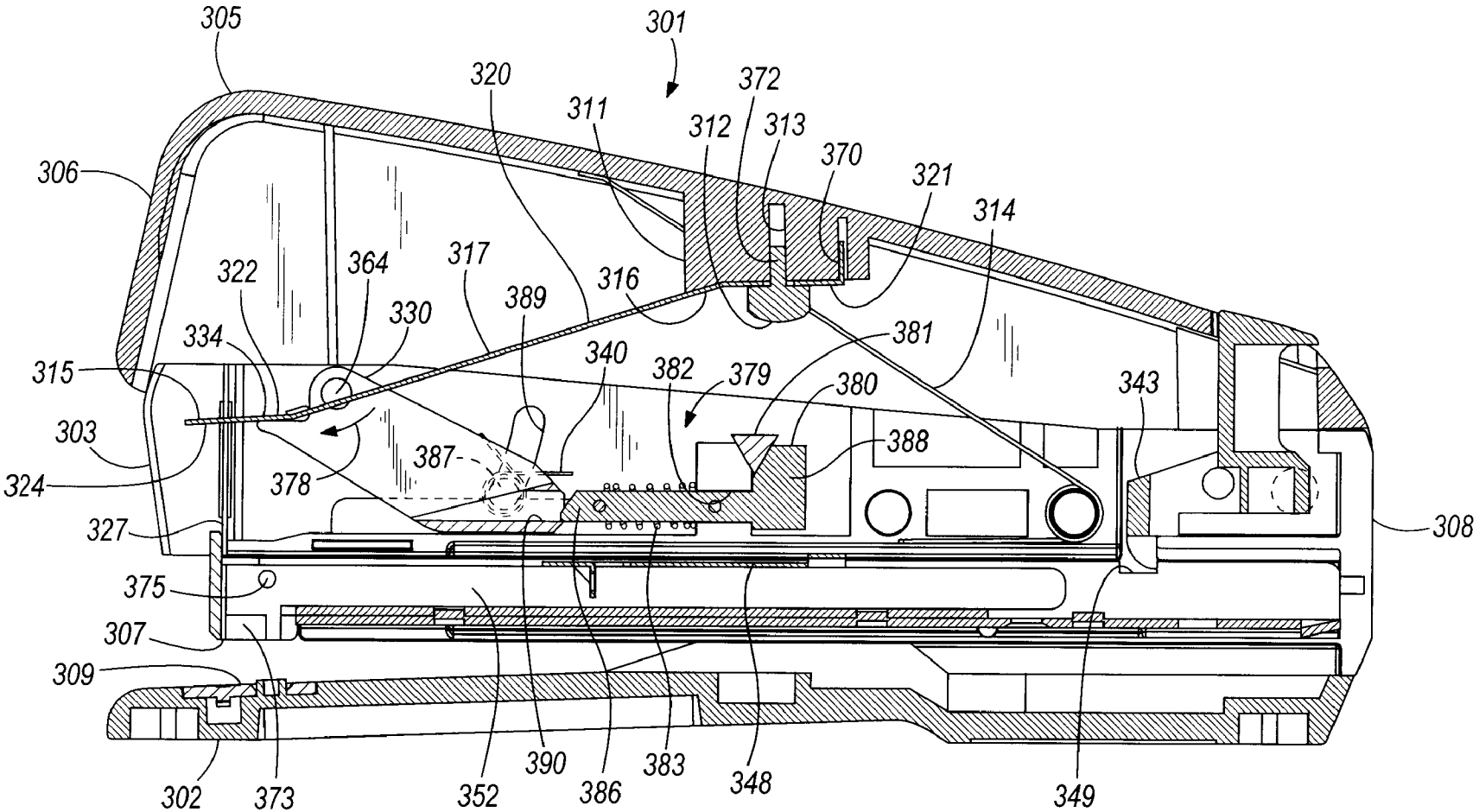
FIG. 23 is yet another alternative embodiment of the stapler of FIG. 1 illustrating the inner configuration of the stapler when the stapler is in the rest or starting position.

FIG. 23 illustrates an alternative construction of the stapler 201 of FIGS. 20-22. The stapler 301 of FIG. 23 is similar to the stapler 201 of FIGS. 20-22. Therefore, like components have been given like reference numbers in the three hundred series, and only the general differences will be discussed below.

The support member 330 of the stapler 301 omits the slider 276 of the stapler 201 of FIGS. 20-22. The support member 330 further includes a boss 387 that is coupled to the support member 330. The boss 387 is positioned in a slot 389 that is formed in the frame 303. The ends of the slot 389 define the maximum rotational positions of the support member 330. The illustrated support member biasing member 340 is located around the boss 387 and biases the support member 330 in the direction indicated by the arrow 378 about the axis 364. In other constructions, the support member biasing member 340 can be located at other suitable locations or in other suitable configurations.

The operation of the stapler 301 is generally the same as the operation of the stapler 201 of FIGS. 20-22 with the exception that the stapler 301 omits the slider 276 of the stapler 201.

FIGS. 24-31 illustrate an alternative embodiment of the staplers of FIGS. 1-23. In the embodiment illustrated in FIG. 24, the stapler 420 is a manual desktop-type stapler. However, the invention can be practiced with substantially any type of stapler, including, but not limited to, manual hand-held or upright staplers, manual heavy-duty staplers, and all forms of electric staplers, including desktop-type, heavy-duty, and hand-held electric staplers.

The illustrated stapler 420 includes a base 424 having a front end 428 and a rear end 432. A bottom 436 of the base can be at least partially covered by a slipper or pad that helps stabilize and minimize sliding movement of the stapler 420 on a support surface (not shown). Should a user grasp the stapler 420 to perform the stapling operation as a hand-held stapler, the slipper also makes gripping the stapler 420 more comfortable to the user, as well as facilitates gripping of the stapler 420 by the user by preventing the user's hand from slipping along the surface of the stapler 420. The base 424 further includes a top surface 444 for receiving and supporting a stack of sheets to be stapled. An anvil 448 is supported by the top surface 444 for clinching staples driven through the stack of sheets.

A magazine assembly 452 is pivotally connected to the rear end 432 of the base 424 about a pivot axis 456, as is understood in the art. The magazine assembly 452 includes left and right side plates 453 (only one side plate 453 illustrated in FIG. 24) that are pivotally coupled to the base about the pivot axis 456, and a staple magazine 455 that is slidably connected to the side plates 453. Additional aspects of the side plates 453 will be discussed in detail below.

The magazine 455 includes a nose piece 460 that wraps around the front end of the magazine 455. While the nose piece 460 of the illustrated embodiment is a separate component from the magazine 455, the nose piece 460 could also be integrally formed as part of the magazine 455, and thereby still define a nose piece 460 coupled to the magazine 455. The magazine 455 has a length M. In one construction, the length M of the magazine ranges from about 140 mm to about 146 mm, and in other constructions, the length M of the magazine can be any suitable length.

Figure 24:
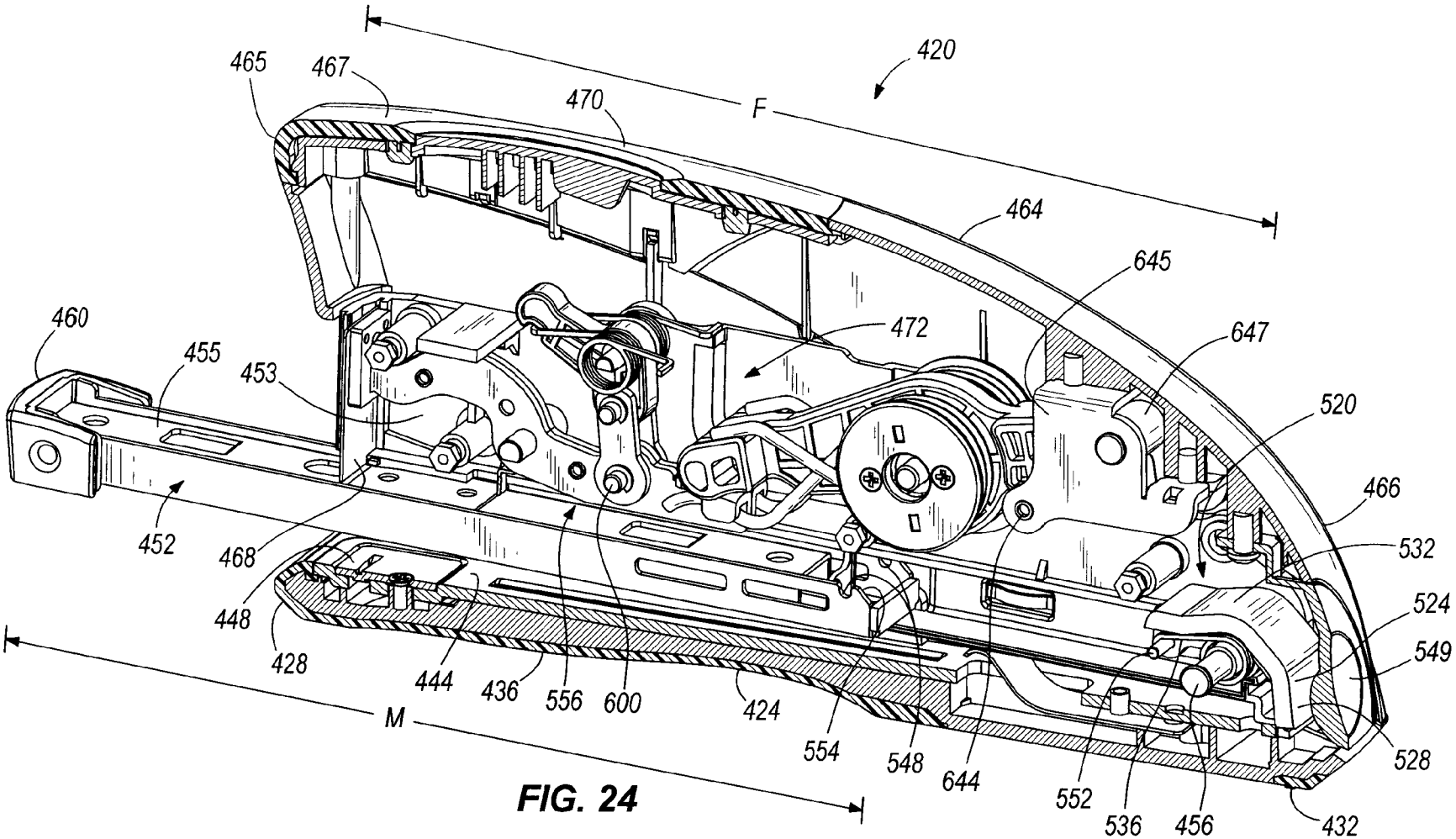
FIG. 24 is yet another alternative embodiment of the stapler of FIG. 1 illustrating a cutaway perspective view with the staple magazine in the staple loading position.
Figure 29:
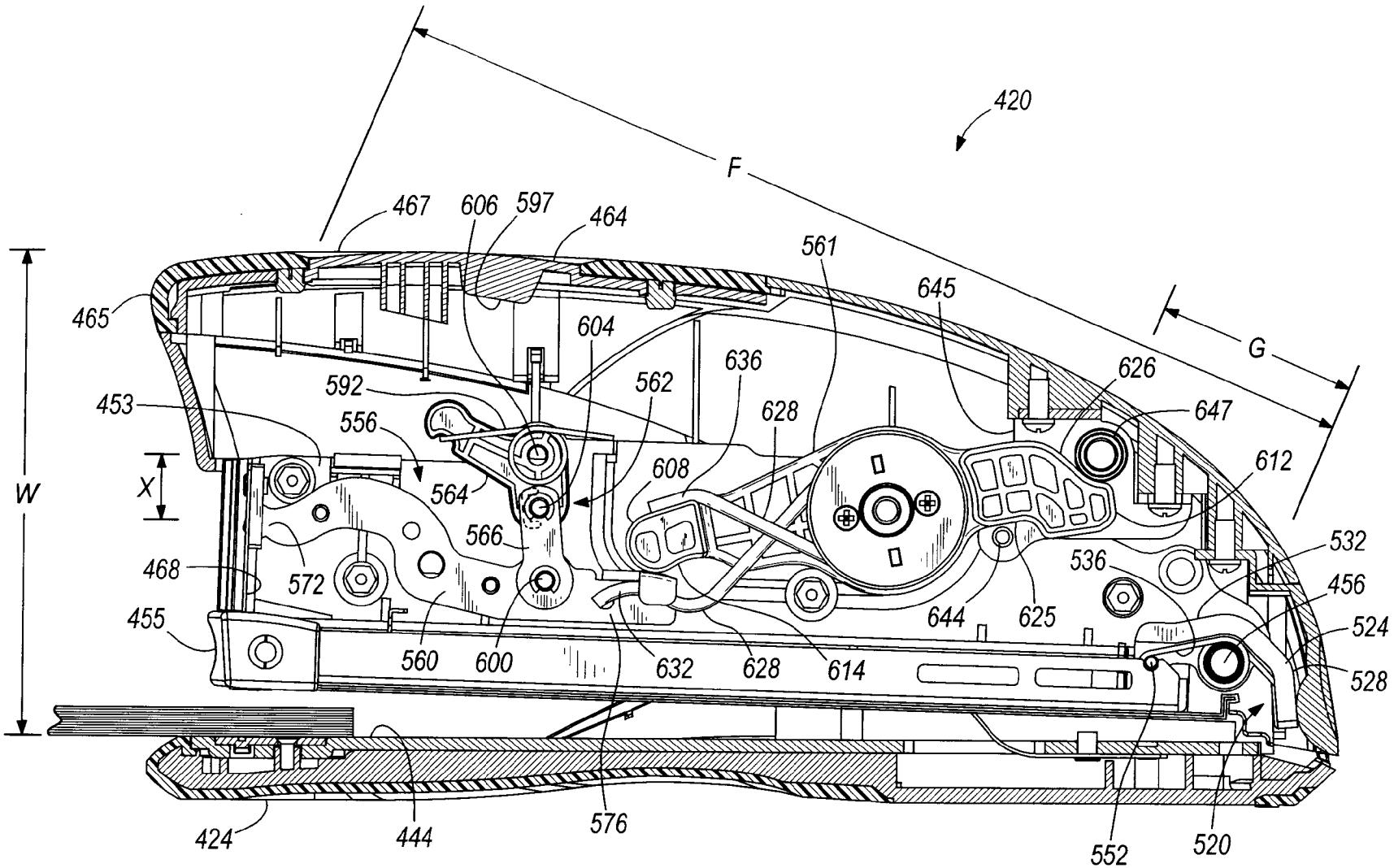
FIG. 29 is a section view of the stapler of FIG. 24 in the rest position.

Referring to FIGS. 24 and 29, a cover 464 is also pivotally connected to the base 424 about the pivot axis 456, and is capable of pivoting both with the magazine 455 and with respect to the magazine 455 during stapling operations. The cover 464 includes an input portion 467 located an input length F from the pivot axis 456 of the cover 464. The input portion 467 is defined as the point of force input by the user into the cover 464. In one construction the input length F ranges from about 153 mm to about 155 mm, and in other constructions the input length F can be any suitable length. An output length G extends from the pivot axis 456 to the point at which the energy input to the cover 464 is input into the stapling mechanism, as will be discussed in detail below. In one construction the length G ranges from about 30 mm to about 37 mm, and in other constructions can be any suitable length.

Referring to FIG. 24, the cover 464 includes a front end 465 and a rear end 466. The cover 464 includes the input portion 467 near the front end 465 of the cover 464 for receiving manual force input into the stapler 420 by a user. A lever portion 470 is defined by the cover 464 between the input portion 467 and the pivot axis 456. The lever portion 470 has a length equal to the input length F. Because the cover 464 pivots about the same pivot axis 456 as the magazine 455, the length of the lever portion 470 (i.e., the input length F) is maximized, thus maximizing the leverage available to the user. Maximizing the leverage by the user reduces the amount of force that must be input by the user to effectively operate the stapler 420. In the one embodiment, the ratio between input length F and the length M of the magazine 455 is between about 80% and 120%. Further aspects of the mechanical advantage of the stapler 420 will be described in detail below.

The stapler 420 also includes a driver blade 468 coupled to a drive mechanism 472 to drive the staples out of the stapler 420 into the stack of sheets. The elements of the drive mechanism 472 will be described in more detail below. The front surface of the driver blade 468 defines a plane of movement in which the driver blade 468 moves downwardly to drive staples out of the stapler 420. As the driver 468 moves downwardly through the magazine 455 to drive out a staple, the driver 468 is supported by the nose piece 460 and prevented from moving out of alignment with the staple to be driven.

Figure 25:
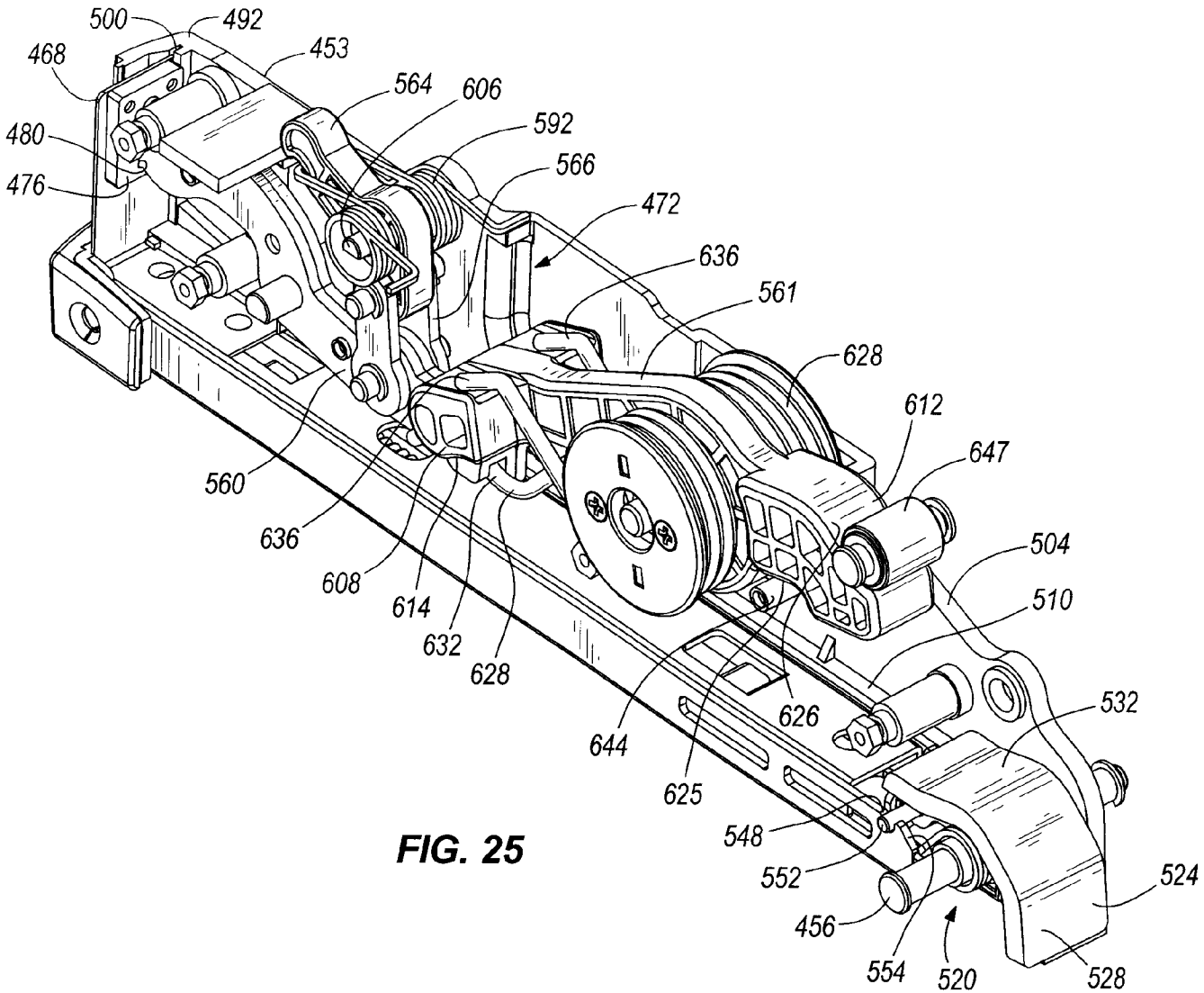
FIG. 25 is a cutaway perspective view of a portion of the stapler of FIG. 24.

As best illustrated in FIG. 25, a stiffening plate 476 is coupled to the rear surface of the driver 468 and includes a slot or aperture 480 therein for receiving a portion of the drive mechanism 472, as will be discussed in detail below. In other constructions, aperture 480 can be omitted, and the drive mechanism 472 can be coupled to the stiffening plate 476 or driver blade 468 by welding, brazing, gluing, bonding, bolting, and the like. The stiffening plate 476 can be coupled to the driver blade 468 via a rivet, embossment, welding, gluing, bolting, and the like. In other constructions, the plate 476 and the driver blade 468 may be integrally formed as one piece. It is also understood that in other embodiments, no stiffening plate is used, and thus the drive mechanism 472 interacts directly with the driver 468.

With continued reference to FIG. 25, a front portion 492 of each side plate 453 (only one side plate 453 is illustrated in FIG. 25) wraps around the front surface of the driver blade 468 and includes slots 500 therein that receive the edges of the driver 468 to help guide the driver 468 during the stapling action. Rear portions 508 of each plate 453 enclose a portion of the drive mechanism 472, and are coupled together along the pivot axis 456. Each plate 453 also includes a rib 510 that extends along at least a portion of the plate.

With reference to FIGS. 25 and 29, the stapler 420 includes a magazine release mechanism 520. The magazine release mechanism 520 includes a pivoting lever 524 that is actuated by the user to release the magazine 455 such that the magazine 455 can be ejected out the front of the stapler 420 into a staple loading position. The illustrated pivoting lever 524 includes a generally vertical surface 528 and a generally horizontal surface 532.

A biasing member 536 is utilized to hold the magazine 455 in the locked position, as illustrated in FIG. 29. In the illustrated construction, the biasing member 536 is a torsion spring that is coupled to the pivoting lever 524 to hold the magazine 455 in the locked position. In other constructions, any suitable mechanism or biasing member can be utilized to bias the pivoting lever 524 into the engaged or locked position.

While not illustrated, the magazine 455 includes a staple pusher spring therein that functions to push or pull staples within the magazine 455 toward the front of the magazine 455 such that the forwardmost staple is in position to be driven out of the stapler 420 by the driver blade 468. The forward bias of the staple pusher spring also functions to bias the magazine 455 toward the front of the stapler 420 such that when the magazine 455 is released, the staple pusher spring pushes the magazine 455 forward to facilitate ejecting the magazine 455 out of the front of the stapler 420 and into the staple loading position.

In one embodiment, the release mechanism 520 also includes a braking spring (not illustrated). When the magazine 455 is released due to actuation of the pivoting lever 524, the force of the staple pusher spring ejects the magazine 455 out of the front of the stapler 420 as discussed above. The more the staple pusher spring is compressed, the greater the ejecting bias of the staple pusher spring. When there are no staples remaining in the magazine 455, the staple pusher spring force is at a minimum. The greater the number of staples remaining in the magazine 455, the greater the staple pusher spring compression and thus the greater the ejecting bias of the staple pusher spring. To maintain control of the ejection of the magazine 455 when the staple pusher spring is compressed, the braking spring is configured to interact with the magazine 455 to slow the ejection of the magazine 455 out of the stapler 420.

In one construction, the braking spring is coupled to the magazine 455 such that the braking spring moves with the magazine 455. When the magazine 455 is released, the braking spring moves forward with the movement of the magazine 455 and engages the rib 510 on the side plate 453. The engagement between the braking spring and the rib 510 causes friction, slowing the forward movement of the magazine 455. The stiffness of the braking spring, and thus the amount of friction created during magazine ejection, should be optimized to ensure a controlled ejection of the magazine 455 when the staple pusher spring is highly compressed, but also ensuring that when the magazine 455 is empty (and thus the staple pusher spring is only lightly compressed), the magazine 455 can be drawn out of the stapler 420 by the user with little difficulty. While one braking spring configuration is described herein, it should be understood that other braking spring configurations are contemplated and would fall within the scope of the present invention.

Referring to FIGS. 24 and 25, the magazine 455 also includes a u-shaped channel 548 therein that receives a locking shaft 552 of the magazine release mechanism 520. The biasing member 536 biases the locking shaft 552 into the channel 548 of the magazine 455 to lock the magazine 455 within the stapler 420. The channel 548 also includes a rear cam surface 554.

To release the magazine 455, the user pushes on the vertical surface 528 of the pivoting lever 524, either directly or via a button 549 coupled with the cover 464, which causes the horizontal surface 532 to rotate in the clockwise direction.

The rotation lifts the locking shaft 552 out of the channel 548. Once the locking shaft 552 exits the channel 548, the magazine 455 unlocks and the bias of the staple pusher spring ejects the magazine 455 out of the front of the stapler 420, subject to the forces of the braking spring described above. In situations where the magazine 455 is empty upon disengagement of the locking shaft 552 from the channel 548, the magazine 455 may be only partially ejected from the stapler 420, and the user may need to manually move the magazine 455 into the final refilling position.

Once the user has refilled the magazine 455 with staples, the user then pushes the magazine 455 back into the stapler 420 against the bias of the staple pusher spring. As the magazine 455 is pushed back into the stapler 420, the locking shaft 552 engages the rear cam surface 554 of the magazine 455 and cams against the surface until the locking shaft 552 travels over the rear cam surface 554 and falls back into the channel 548 to hold the magazine 455 in the locked position.

Figure 26:
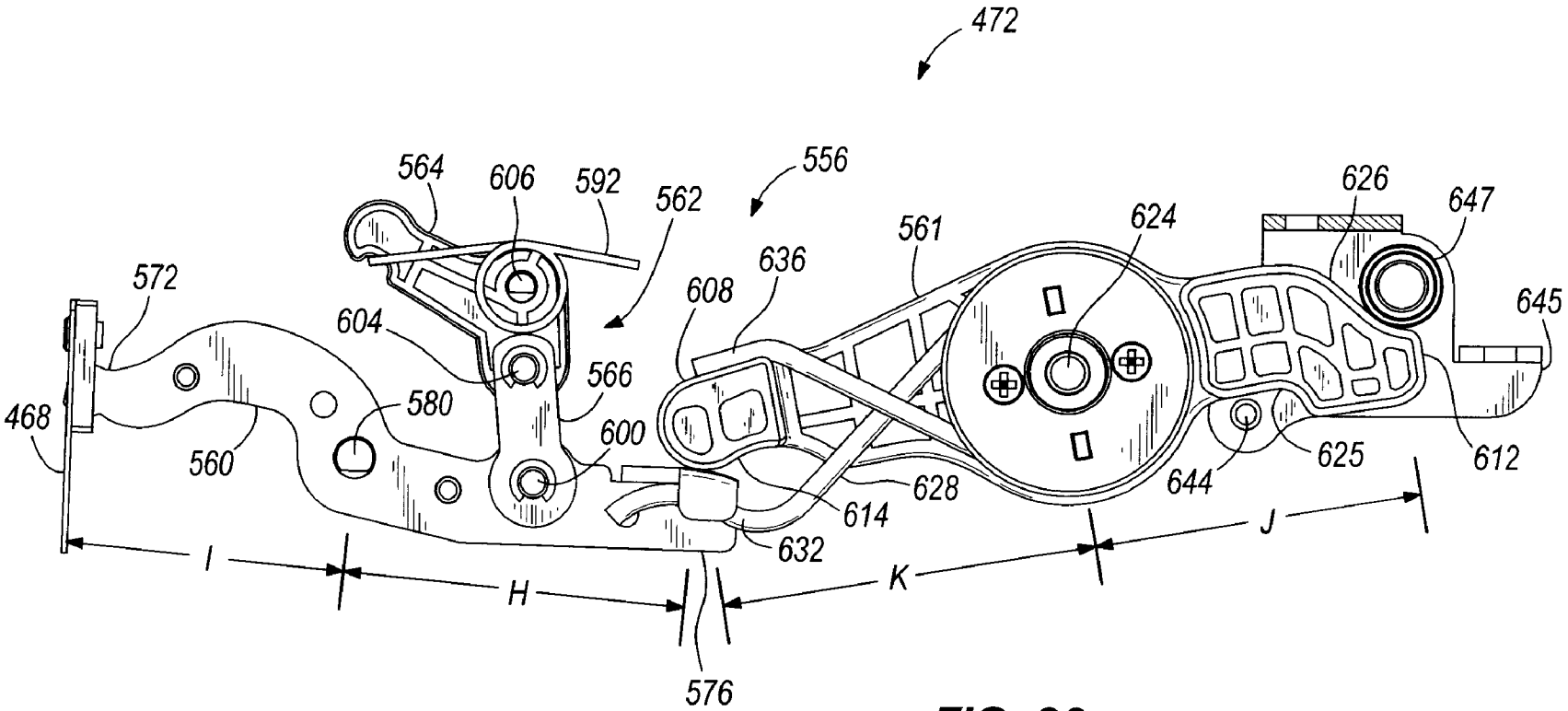
FIG. 26 is a side view of a drive mechanism of the stapler of FIG. 24.
Figure 27:
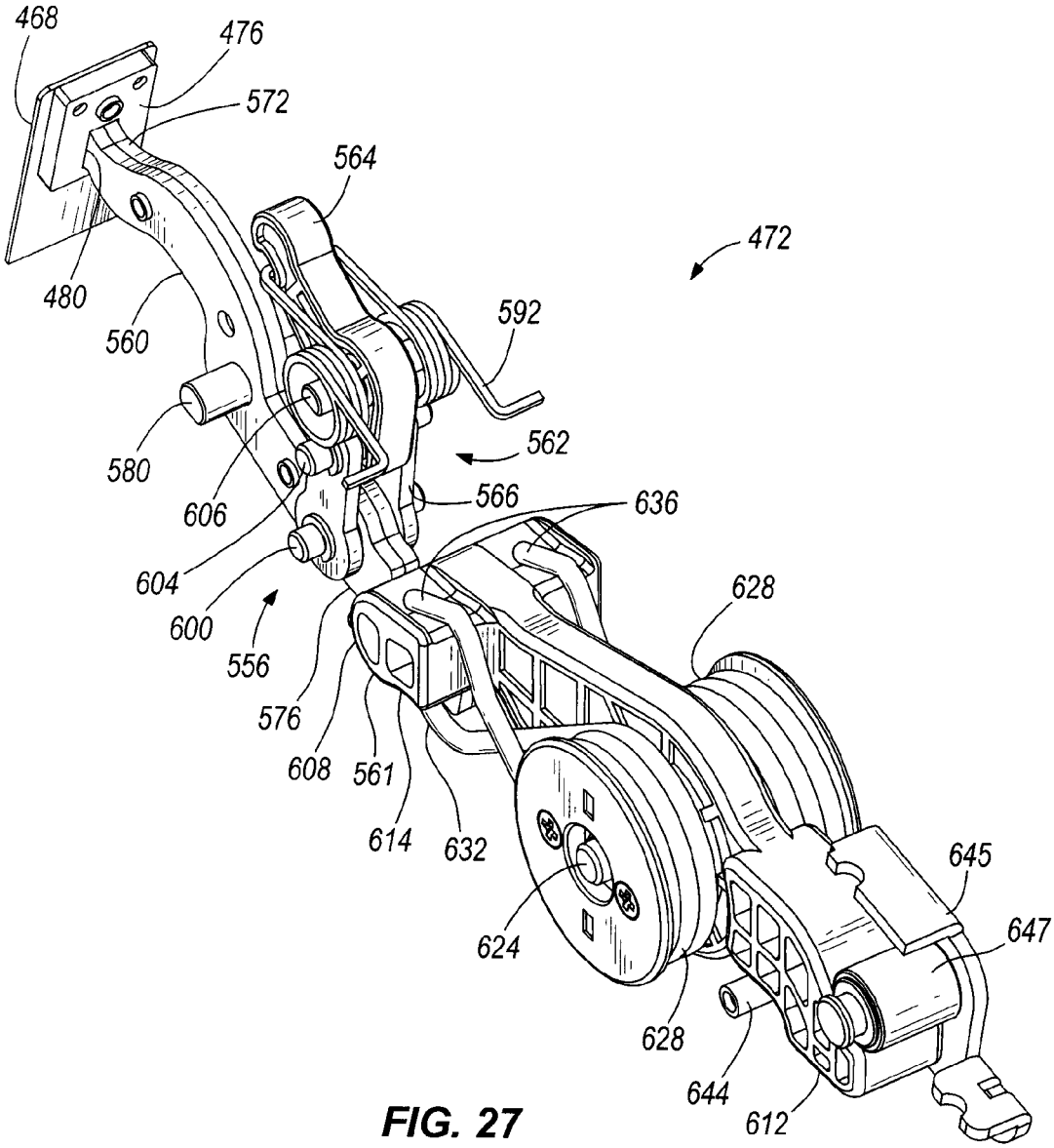
FIG. 27 is a perspective view of the drive mechanism of the stapler of FIG. 24.
Figure 28:
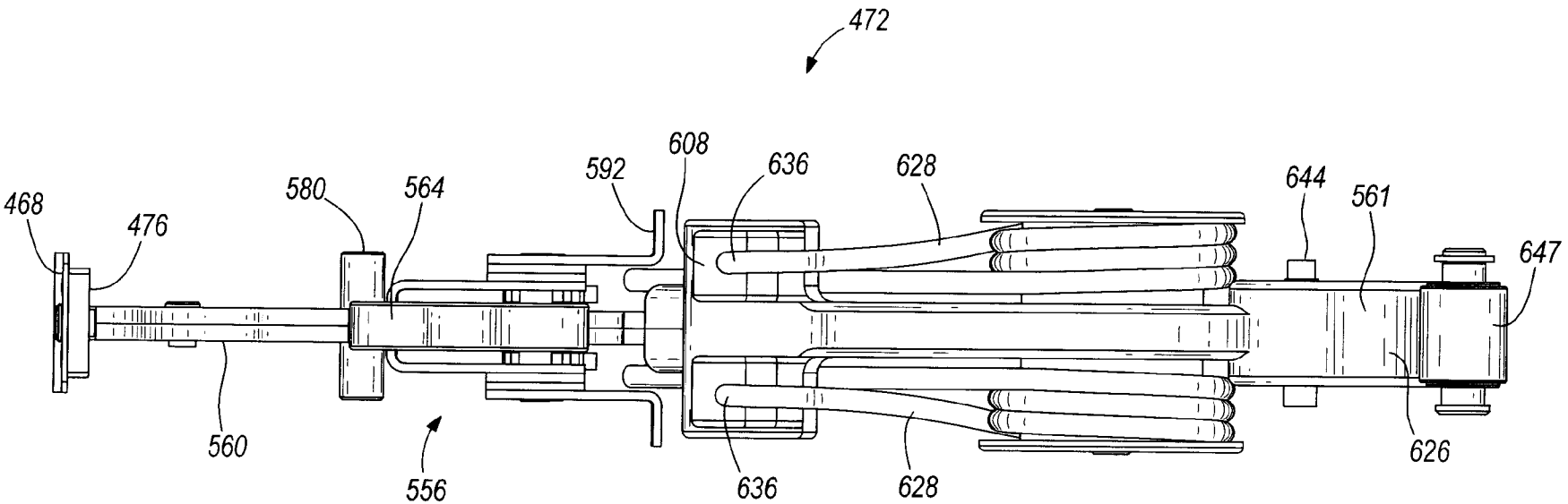
FIG. 28 is a top view of the drive mechanism of the stapler of FIG. 24.

As best shown in FIGS. 26 and 27, the drive mechanism 472 includes a drive linkage 556 that includes a drive link 560, a spring link 561, and an over-center linkage 562 having a trip link 564 and a pivot link 566.

The drive link 560 includes a front end 572 that engages the aperture 480 in the stiffening plate 476 that is coupled to the driver blade 468, and a rear end 576. The front end 572 continuously engages the aperture 480 during all stages of stapling operations. In one construction, the rear end 576 is somewhat wedge-shaped in configuration. The drive link 560 pivots about a pivot point 580. The geometry of the drive link 560 is configured to take advantage of residual energy within the drive mechanism 472 after the stapling operation to return the stapler 420 to the rest position, as will be discussed in more detail below. The drive link 560 includes an input portion having a length H. In one construction the length H ranges from about 29 mm to about 33 mm, and in other constructions can be any suitable length. The drive link 560 further includes an output portion having a length I that is approximately 27 mm in one construction, and can be any suitable length in other constructions. The input portion H is the portion of the drive link 560 between the rear end 576 that receives energy to the pivot point 580, and the output portion I is the portion of the drive link 560 between the pivot point 580 and the front end 572 that directs energy into the driver blade 468.

The trip link 564 of the over-center linkage 562 is pivotably coupled to the pivot link 566 of the over-center linkage 562. The trip link 564 is biased by a torsion spring 592 into an over-center position. The trip link 564 is configured to cooperate with the cover 464 of the stapler 420 to trigger stapling operation, as will be discussed in detail below. The pivot link 566 is coupled to the drive link 560 via a shaft 600. The trip link 564 pivots with respect to the pivot link 566 about a pivot shaft 604. The trip link 564 is supported between the side plates 453 on shaft 606 (FIG. 25). The spring 592 is positioned about the shaft 606. As best illustrated in FIG. 26, in the over-center position, the pivots shafts 600, 604, 606 of the over-center linkage 562 are generally aligned, the function of which will be described below.

Referring to FIGS. 25-27, the spring link 561 includes a cam end 608 that engages the rear end 576 of the drive link 560, and a rear end 612. The cam end 608 includes an integral cam surface or cam member 614. It should be understood that while the cam member 614 of the illustrated embodiment is an integrally formed and fixed cam member, movable cam members, such as a roller, can be used and still fall within the scope of the present invention. The spring link 561 includes an input portion having a length J that ranges from about 23 mm to about 32 mm in one construction, and an output portion having a length K of approximately 36 mm in one construction. In other constructions, the lengths J and K can be any suitable length. The input portion of the spring link 561 is the portion between the rear end 612 and a shaft 624 about which the spring link 561 pivots that receives energy from the cover 464, and the output portion is the portion between the shaft 624 and the cam end 608 that transmits energy to the drive link 560.

The rear end 612 of the spring link 561 includes cam surfaces 625 and 626, the function of which will be described in detail below. While the illustrated spring link 561 is formed from a single piece, in other constructions, the spring link 561 can be formed of multiple part halves that are fastened together via rivets, bonding, gluing, welding, etc. The spring link 561 pivots about the shaft 624 supported by the rear portions 504 of the side plates 453.

The drive mechanism 472 also includes an elastic member or energy storage device, shown in the illustrated embodiments as dual torsion springs 628, housed between the rear portions 504 of the side plates 453. It should be understood that while two torsion springs 628 are shown in the illustrated embodiments, a single torsion spring could also be used and would fall within the scope of the present invention.

Each of the torsion springs 628 includes a first end 632 and a second end 636. The first ends 632 contact the underside of the rear end 576 of the drive link 560, biasing the rear end 576 upwardly. The second ends 636 rest on top of the cam end 608 of the spring link 561, biasing the cam member 614 into contact with the rear end 576 of the drive link 560. Neither the ends 632, 636 of the springs 628 are fixed, with the second ends 636 being charged during a first portion of the stapling operations (i.e., a first stapler condition), and with the first ends 632 releasing energy into the drive mechanism 472 during a second portion of the stapling operations (i.e., a second stapler condition).

It should be understood that FIGS. 25-26 illustrate the springs 628 in a preloaded position. In the preloaded position, some energy is stored in the springs 628 at all times.

Referring to FIGS. 24, 26, and 27, the cover 464 of the stapler 420 includes an activation member 644. The illustrated activation member 644 is supported by a chassis 645 that supports a roller 647. The chassis 645 is coupled to the inside of the cover 464. While the illustrated activation member 644 is support by the chassis 645, in other constructions the activation member could be integrally formed with the cover, or could be the inside surface of the cover 464 itself. The activation member 644 is configured to cooperate with the rear end 612 of the spring link 561 during the stapling operation. The activation member 644 engages the spring link 561 to allow the user to lift the cover 464 in order to manually reset the stapler, discussed in more detail below. While the illustrated activation member is a pin, in other constructions the activation member can be a substantially hook shaped member that depends downwardly from the inside surface of the cover 464. In yet other constructions, the activation member can be any suitable member, such as a post coupled to the spring link that moves within a slot.

Figure 30:
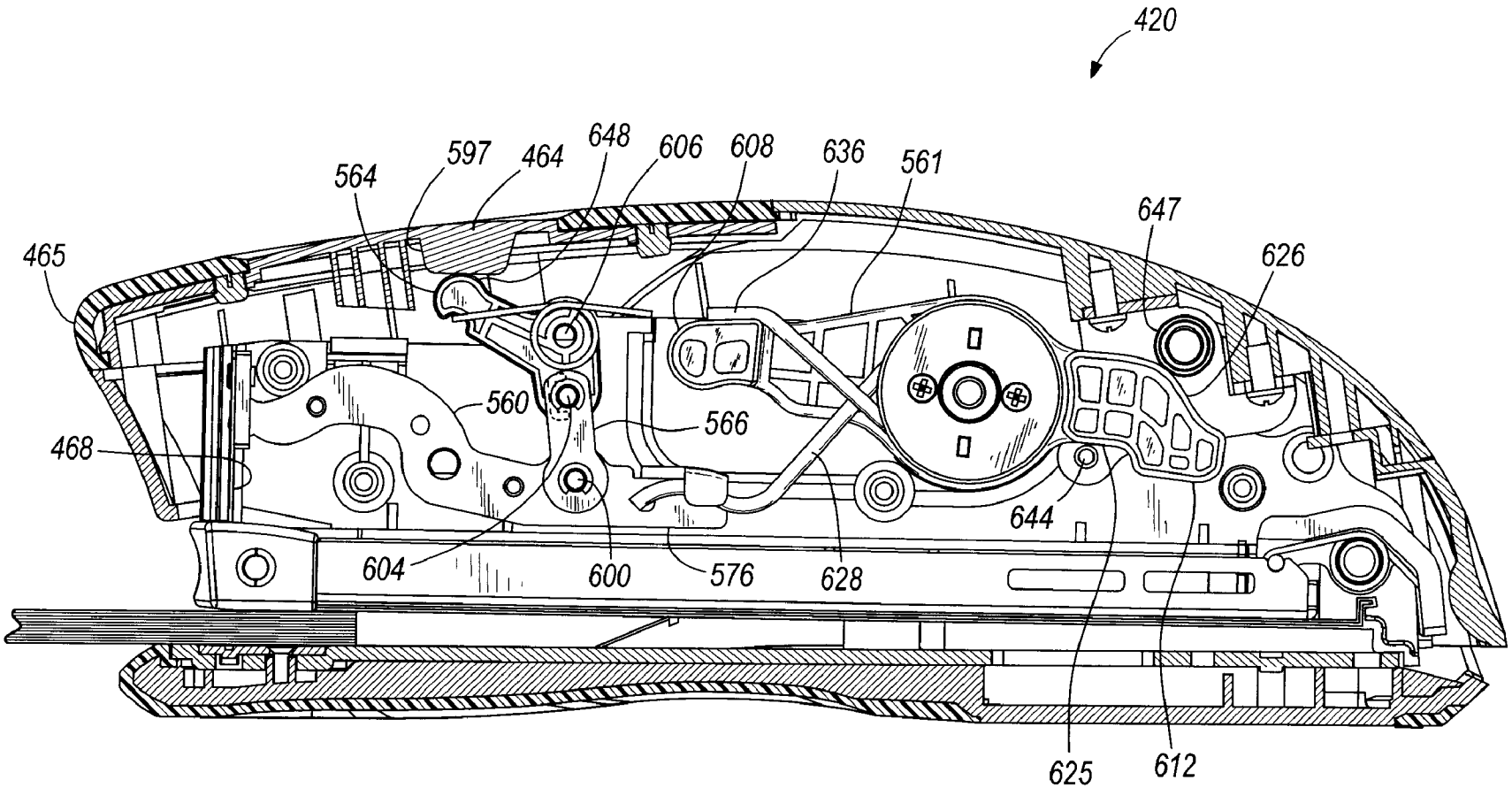
FIG. 30 is a section view of the stapler of FIG. 24 in a partially actuated position.
Figure 31:
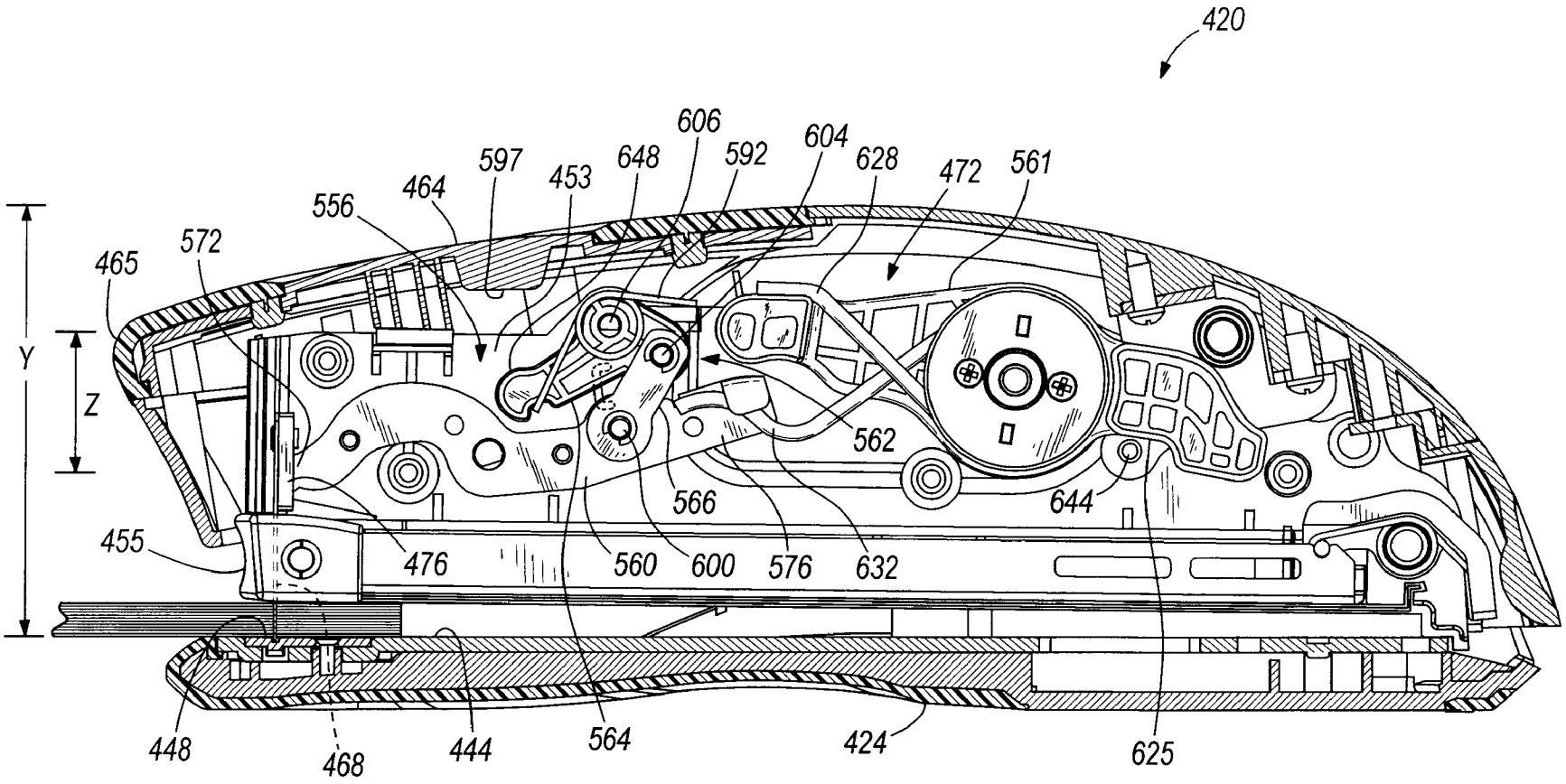
FIG. 31 is a section view of the stapler of FIG. 24 in a fully actuated position.

FIGS. 29-31 illustrate the stapler 420 during various phases of the stapling operation and illustrate the method of operating the drive mechanism 472 described above.

FIG. 29 illustrates the stapler 420 in the rest position. The driver 468 remains above the magazine 455 (i.e., in the up position) when the stapler is at rest due to the over-center arrangement of the over-center linkage 562, which in the illustrated construction includes the trip link 564 and the pivot link 566. This allows the magazine 455 to be ejected out of the front of the stapler 420 if the user wishes to place additional staples within the magazine 455. The torsion springs 628 are in the preloaded position within the stapler 420. The first ends 632 of the springs 628 bias the rear end 576 of the drive link 560 upwardly into the cam end 608 of the spring link 561. Likewise, the second ends 636 of the springs 628 biases the cam end 608 into the rear end 576 of the drive link 560 such that the cam member 614 cams against the rear end 576 of the drive link 560. The cam surface 626 on the rear end 612 of the spring link 561 is in contact with the roller 647 coupled to the cover 464 via the chassis 645. The trip link 564 of the over-center linkage 562 is biased into the over-center position by the torsion spring 592 maintaining the pivot link 566 in its over-center position as well. The cover 464 is in the extended position when the stapler 420 is in the rest position.

In the rest position, the cover 464 defines a vertical distance W between the top of the front end 465 and the top surface 444 of the base. In one construction, the vertical distance W ranges from about 73 mm to about 87 mm, and in other constructions can be any suitable distance. The driver 468 defines a vertical distance X between the top of the plate 453 and the midpoint of the front end 572 of the drive link 560. In one construction, the vertical distance X ranges from about 10 mm to about 13 mm, and in other constructions can be any suitable distance.

As the user inputs manual force into the stapler 420 by pressing on the input portion 467 of the cover 464, the cover 464 and the magazine 455 pivot downwardly with respect to the base 424 such that the cover 464 moves from the extended position toward the depressed position. Inputting force into the stapler 420 charges the stapler, resulting in the first, charged stapler condition. As the cover 464 pivots, the roller 647 coupled to the cover 464 near the rear end 612 of the spring link 561 rolls along the cam or support surface 626 of the spring link 561, causing the front end 608 of the spring link 561 to pivot upwardly against the bias of the second ends 636 of the torsion springs 628, charging the springs 628. The movement of the spring link 561 causes the torsion springs 628 to fully deflect, storing more potential energy within the springs 628. The rear end 576 of the drive link 560 remains in the rest position due to the over-center bias of the trip link 564 overcoming the upward bias of the first ends 632 of the springs 628 and the alignment of the pivot shafts 600, 604, and 606 of the over-center linkage 562.

FIG. 30 illustrates the stapler 420 after the manual force inputted by the user has caused the cover 464 to pivot toward the trip link 564 of the over-center linkage 562. At the point of driver 468 release, a tab or protrusion 597 integrally formed on the inside surface of the cover 464 will contact with an outer end 648 of the trip link 564. As illustrated in FIG. 30, the drive link 560 and the trip link 564 have not yet moved from the rest position and the pivot shafts 600, 604, and 606 of the over-center linkage 562 remain aligned. Of course the protrusion 597 could be a separate part coupled to the cover, trip link, or the cover could be configured such that no protrusion is necessary.

Referring to FIG. 31, the interaction between the cover 464 and the outer end 648 of the trip link 564 moves the trip link 564 with respect to the pivot link 566 to move the pivot shaft 604 cut of the over-center position (i.e., out of alignment with the pivot shafts 600 and 606), overcoming the bias of the torsion spring 592. As the trip link 564 snaps out of the over-center position the pivot shafts 600, 604, and 606 of the over-center linkage 562 are no longer aligned and there is no longer any force opposing the upward bias of the first ends 632 of the springs 628 on the rear end 576 of the drive link 560. This allows the springs 628 to snap back to the preload position, releasing the charged energy within the springs 628 into the drive linkage 556 through the first ends 632 of the spring 628 forcing the rear end 576 of the drive link 560 upwardly, which in turn drives the front end 572 of the drive link 560 downwardly. This is the second, released stapler condition.

Because the front end 572 of the drive link 560 is continuously engaged with the driver 468 via the aperture 480 in the stiffening plate 476, the release of potential energy from the spring 628 drives the driver 468 downwardly through a driver stroke, causing the driver 468 to drive a staple within the magazine 455 out of the stapler 420 (in the stapling direction) and into a waiting stack of sheets. As mentioned above, the triggering mechanism of the stapler 420 (e.g., the over-center linkage 562 in the illustrated embodiment) does not directly engage and hold the driver blade 468, thereby eliminating many of the triggering mechanism and locking mechanism problems associated with prior art staplers.

Moving from FIG. 30 to FIG. 31, the cover 464 moves into the depressed position as the stapler is in the stapling position. In the stapling position, the cover 464 defines a vertical distance Y between the top of the front end 465 and the top surface 444 of the base 424 and the driver 468 defines a vertical distance Z between the top of the plate 453 and the midpoint of the front end 572 of the drive link 560. In one construction, the vertical distance Y ranges from about 53 mm to about 57 mm, and the vertical distance Z ranges from about 19 mm to about 25 mm. In other constructions the vertical distances Y and Z can be any suitable length.

Referring to FIGS. 29 and 31, during the stapling operation, the driver 468 moves vertically through the driver stroke. The driver stroke represents the vertical movement of the driver 468 upon actuation by the drive linkage 556, and has a length calculated by subtracting the vertical distances of the driver 468 identified above (i.e., Z-X). At the point of release of the driver 468, no additional manual force input from the user is required to perform the stapling operation, and any additional manual force directed into the cover 464 will not be translated to the driver 468 as there is no contact between the cover 464 and the driver 468 once the driver 468 is released. Thus, the stapler 420 achieves full power and is fully automated for as many sheets as can be received by the stapler 420.

The downward force of the driver 468 also assists in the clinching of the staple legs as the staple legs pass through the stack of sheets into the anvil 448. Similar to the stapler 201 of FIG. 21, and as illustrated in FIG. 31, a bottom portion of the driver 468 extends through and out of the magazine 455 after the staple has been driven. The driver 468 is not mechanically stopped during the stapling operation such that the continued movement of the driver 468 through the bottom of the magazine 455 imparts additional force to the staple as the staple enters the stack of sheets and is clinched. The continued movement of the driver 468 and the residual force remaining in the drive mechanism 472 after stapling due to the preloading of the springs 628 help to complete the staple clinch and returns the stapler 420 to the rest position as will be described in more detail below.

Referring to FIGS. 29-31, the total vertical movement in the stapling direction of the front end 465 of the cover 464 as compared with the total vertical movement of the driver 468 during the driver stroke represents the mechanical advantage realized in the stapler 420. The total vertical movement of the front end 465 of the cover 464 (i.e., a first vertical distance) can be calculated by taking the vertical distance W in the stapler rest position minus the vertical distance Y in the stapling position. In one construction of the stapler, the first vertical distance ranges from about 16 mm to about 34 mm. Similarly, the total vertical movement of the driver 468 during the driver stroke (i.e., a second vertical distance) is calculated as described above, subtracting X from Z. In one construction, the second vertical distance ranges from about 9 mm to about 12 mm. In one embodiment, the mechanical advantage of the stapler 420 ranges from about 1.8:1 to about 4:1. In other embodiments, the mechanical advantage ranges from about 3:1 to about 8:1. The greater the vertical distance traveled by the cover 464 with respect to the distance traveled by the driver 468 during the driver stroke, the greater the mechanical advantage in the stapler.

Referring to FIGS. 24, 26, and 29 another method of determining or quantifying the mechanical advantage of the stapler is to calculate the mechanical advantage through the input and output lengths of the cover 464 and the drive linkage 556. With respect to the calculation of mechanical advantage in the stapler 420, the cover 464 acts as a link in the drive linkage 556.

Some amount of mechanical advantage is generated by the geometry of the cover 464, the geometry of the drive link 560, and the geometry of the spring link 561. The mechanical advantage in the drive link 560 is calculated by dividing the input length H of the drive link 560 by the output length I. Thus, in one construction, the mechanical advantage of the drive link 560 ranges from about 2.8 to about 5.4. In the illustrated embodiment, the mechanical advantage in the drive link is equal to 33 mm/27 mm (H/I), or approximately 1.2. Similarly, the mechanical advantage of the spring link 561, in one construction is 32 mm/36 mm (J/K), or approximately 0.88. The mechanical advantage of the cover 464 is equal to the input length F of the cover 464 divided by the output length G. In one construction, the mechanical advantage of the cover 464 is 153 mm/30 mm (F/G), or approximately 5.1.

To calculate the total mechanical advantage from the examples above for the stapler 420, the mechanical advantage of the cover 464 is multiplied by the mechanical advantage of the drive link 560 and the mechanical advantage of the spring link 561. Therefore, using the construction described above, the stapler 420 has a mechanical advantage of 1.2*0.88*5.1, or approximately 5.4. Using this formula, changing the geometry of any of the cover 464, the drive link 560, or the spring link 561, such as changing the length of the input and/or output portions, would directly affect the mechanical advantage of the stapler The method described above results in a stapler 420 with improved stapling function requiring less force input by the user due to the use of the potential energy that naturally builds within the drive mechanism 472 to drive the staples out of the stapler 420. The configuration of the cover 464 and the drive linkage 556 increases the leverage available to the user such that the amount of force needed from the user to deflect the torsion springs 628 and store energy in the springs 628 is reduced, as discussed in detail above.

Because the torsion springs 628 are preloaded, a residual amount of potential energy remains in the drive mechanism 472 at all times such that even after staple driving, the residual potential energy can assist with completing the staple clinch and returning the stapler 420 to the rest position, due in part to the geometry of the drive link 560. The geometry of the over-center linkage 562, which includes the trip link 564 and the pivot link 566, (i.e., the over-center arrangement) maintains the driver 468 above the magazine 455 in the stapler rest position to allow for front loading of the staples.

When there is no staple jam, the drive linkage 556 will naturally want to reset itself due to the residual energy in the springs 628. Prior art staplers required a user to manually reset the stapler to rest, or utilized an additional spring for the express purpose of resetting the stapler to rest. The geometry of the drive mechanism 472, including the drive linkage 556, of the stapler 420 automatically resets the stapler 420 to the rest position. The shape of the rear end 576 of the drive link 560 and the cam end 614 of the spring link 561 maintain a large gap (i.e., the difference in height) between the first and second ends 432, 436 of the springs 628. The gap imparts additional potential energy into the springs 628. The gap naturally tends toward closure to release energy built up within the springs 628. This tendency to close lifts up on the rear end 576 of the drive link 560, and pushes downwardly on the cam end 608 of the spring link 561 such that the roller 647 engages the cam surface 626 of the of the rear end 612 of the spring link 561. All of this movement described above works to automatically reset the stapler 420 to the rest position after a staple is driven out of the stapler 420.

Further, in a staple jam situation, the drive mechanism 472 allows the user to manually lift the cover 464 to reset the stapler and the drive mechanism 472 to the rest position. When the cover 464 is lifted, the actuation member or pin 644 moves upwardly with the cover 464 and into engagement with the cam surface 625 on the bottom of the spring link 561. Continued upward movement of the actuation member 644 raises the rear end 612 of the spring link 561 back to the position shown in FIG. 29, allow the rest of the linkages in the drive mechanism 472 to reset to the rest position shown in FIG. 29.

It should be understood that the specific component measurements discussed above, such as the specific vertical distances, the link input lengths, the link output lengths, etc., are illustrative of a specific embodiment of a stapler according to the invention. It is understood that the lengths, measurements, and specific geometries of the components of the stapler described above can be adjusted or changed, and will still fall within the scope of the present invention.

Various features of the invention can be found in the following claims.

What is claimed is:

1. A stapler movable between a rest position, in which no force is input to the stapler by a user, and a stapling position, the stapler having a front end adjacent a staple ejection location and a rear end, the stapler comprising:

a base;

a staple magazine coupled to the base and configured to hold staples;

a driver blade operable to drive staples out of the staple magazine during stapling operations;

an elastic member coupled to the driver blade and operable to move the driver blade during stapling operations, the elastic member utilizing potential energy to move the driver blade during stapling operations;

a drive link having a first end coupled to the driver blade and a second end coupled with the elastic member; and an over-center linkage having first and second link members pivotally connected together and movable between a first position in which the driver blade is prevented from driving a staple out of the staple magazine, and a second position in which the driver blade is operable to drive a staple out of the staple magazine;

wherein the first and second link members are pivotally connected about a first pivot axis, the first link member is pivotally connected to the drive link about a second pivot axis, and the second link member is pivotally connected to another portion of the stapler relative to which the drive link is movable, about a third pivot axis.

2. The stapler of claim 1, wherein the driver blade extends at least partially out of the staple magazine when the stapler is in the stapling position.

3. The stapler of claim 1, wherein the drive link is in continuous engagement with the driver blade during stapling operations.

4. The stapler of claim 1, wherein the over-center linkage moves between the first and second positions due to engagement with a cover of the stapler.

5. The stapler of claim 1, wherein the elastic member is a torsion spring.

6. The stapler of claim 1, wherein the staple magazine is connected to an end of the base for movement with respect to the base about a pivot axis during stapling operations, and wherein a cover is coupled to the end of the base for movement about the same pivot axis as the staple magazine.

7. The stapler of claim 1, wherein the elastic member is preloaded such that energy is stored within the elastic member when the stapler is at the rest position, and the stapling position, and at all positions between the rest position and the stapling position.

8. The stapler of claim 1, further comprising a triggering mechanism operable to release potential energy stored in the elastic member, wherein the triggering mechanism does not directly contact and hold the driver blade.

9. The stapler of claim 1, further comprising a cover, and wherein the cover cannot contact the driver blade to input force to the driver blade during stapling operations.

10. The stapler of claim 1, wherein the driver blade is positioned entirely above staples housed in the staple magazine when the stapler is in the rest position and the magazine is extendable from the front end of the stapler to allow a user to load staples in the magazine.

11. The stapler of claim 1, wherein the stapler is configured such that only the potential energy of the elastic member can operate the driver blade during stapling operations.

12. The stapler of claim 1, further comprising an activation member configured such that when a staple jam occurs a user can manually reset the stapler to the rest position, wherein the stapler includes a cover coupled to the magazine, and wherein the activation member is a pin coupled to the cover for movement with the cover.

13. A stapler movable between a rest position and a stapling position, the stapler having a front end adjacent a staple ejection location and a rear end, the stapler comprising:

a base;

a staple magazine coupled to the base and configured to hold staples;

a driver blade operable to drive staples out of the staple magazine during stapling operations;

an elastic member coupled to the driver blade and operable to move the driver blade during stapling operations, the elastic member utilizing potential energy to move the driver blade during stapling operations; and an over-center linkage having first and second link members pivotally connected together and movable between a first position in which the driver blade is prevented from driving a staple out of the staple magazine, and a second position in which the driver blade is operable to drive a staple out of the staple magazine;

wherein the first and second link members are pivotally connected about a first pivot axis, the first link member is pivotally connected to a drive link about a second pivot axis, and the second link member is pivotally connected to another portion of the stapler relative to which the drive link is movable, about a third pivot axis;

wherein the first, second, and third pivot axes are generally aligned in a straight line when the over-center linkage is in the first position; and wherein the first, second, and third pivot axes are not aligned in a straight line when the over-center linkage is in the second position.

14. The stapler of claim 13, wherein the drive link is coupled with the driver blade and the elastic member, and has a pivot point about which the drive link pivots, and wherein the over-center linkage is coupled with the drive link such that, when the over-center linkage is in the second position, the drive link is allowed to pivot about the pivot point to drive the driver blade.

15. The stapler of claim 13, wherein the over-center linkage moves from the first position to the second position upon engagement of a portion of the over-center linkage with a cover of the stapler.

16. The stapler of claim 13, wherein a biasing member biases the over-center linkage toward the first position.

17. The stapler of claim 13, wherein the driver blade is positioned entirely above staples housed in the staple magazine when the stapler is in the rest position and the magazine is extendable from the front end of the stapler to allow a user to load staples in the magazine.

18. The stapler of claim 13, wherein the drive link is coupled with the driver blade and the elastic member, and wherein the drive link is in continuous engagement with the driver blade during stapling operations.

19. A stapler comprising:

a base;

a staple magazine coupled to the base and configured to hold staples;

a driver blade operable to drive staples out of the staple magazine during stapling operations;

an elastic member coupled to the driver blade and operable to move the driver blade during stapling operations, the elastic member utilizing potential energy to move the driver blade during stapling operations;

a drive link coupled with the driver blade and the elastic member, and having a pivot point about which the drive link pivots; and an over-center linkage having first and second link members pivotally connected together and movable between a first position in which the driver blade is prevented from driving a staple out of the staple magazine, and a second position in which the driver blade is operable to drive a staple out of the staple magazine;

wherein the first and second link members are pivotally connected about a first pivot axis, the first link member is pivotally connected to the drive link about a second pivot axis, and the second link member is pivotally connected to another portion of the stapler relative to which the drive link is movable, about a third pivot axis; and wherein the over-center linkage is coupled with the drive link such that, when the over-center linkage is in the first position, the drive link is not allowed to pivot about the pivot point, and when the over-center linkage is in the second position, the drive link is allowed to pivot about the pivot point to drive the driver blade.

20. The stapler of claim 19, wherein the stapler is movable between a rest position and a stapling position, wherein the stapler has a front end adjacent a staple ejection location and a rear end, and wherein the driver blade is positioned entirely above staples housed in the staple magazine when the stapler is in the rest position and the magazine is extendable from the front end of the stapler to allow a user to load staples in the magazine.

* * * * *

UNITED STATES PATENT AND TRADEMARK OFFICE

CERTIFICATE OF CORRECTION

PATENT NO. : 7,681,771 B2
APPLICATION NO. : 11/424629
DATED : March 23, 2010
INVENTOR(S) : Balaji Kandasamy et al.

It is certified that error appears in the above-identified patent and that said Letters Patent is hereby corrected as shown below:

Title page, item (75) Inventors:
"Edward T. Eaton, Wheaton, IL (US)" should read --Edward T. Eaton, Eola, IL (US)--
"David J. Papesh, Channahon, IL (US)" should read --David J. Papesh, Joliet, IL (US)--
"Yoshiyuki Eibhara, Tokyo (JP)" should be removed
"Yuki Hamaguchi, Tokyo (JP)" should be removed Title page, item (*) Notice:
"This patent is subject to a terminal disclaimer" should be removed Title page, item "(30) Foreign Application Priority Data
Jun. 17, 2005 (JP).....2005-177441" should be removed Title page, item (56) References Cited
FOREIGN PATENT DOCUMENTS Before FR 2593251 7/1987 insert:
--EP 0281541 9/1988
EP 0698448 2/1996--

After FR 2593251 7/1987 insert:
--GB 540611 10/1941
GB 2229129 9/1990--

Signed and Sealed this

Twenty-fifth Day of May, 2010

David J. Kappos

David J. Kappos
*Director of the United States Patent and Trademark Office*